United States Patent [19]

Rovin et al.

[11] 4,244,313

[45] * Jan. 13, 1981

[54] AUTOMATIC, IN SITU BOBBIN SPOOL LOADING

[75] Inventors: Herman Rovin, Norwalk, Conn.; Lawrence J. Levine, Valley Stream, N.Y.; Theodore Opuszenski, Darien, Conn.; Joseph Pellicano, Greenwich, Conn.; Alan F. Swenson, Norwalk, Conn.

[73] Assignee: Automatech Industries Inc., Piedmont, S.C.

[ * ] Notice: The portion of the term of this patent subsequent to Oct. 3, 1995, has been disclaimed.

[21] Appl. No.: 896,884

[22] Filed: Apr. 17, 1978

Related U.S. Application Data

[63] Continuation-in-part of Ser. No. 833,178, Sep. 14, 1977, Pat. No. 4,117,789.

[51] Int. Cl.[3] ..... D05B 57/26; D05B 37/04; D05B 45/00; H03K 17/00

[52] U.S. Cl. ..... 112/279; 226/113; 226/158; 242/20; 112/186; 112/181

[58] Field of Search ..... 242/20–24, 242/118.4, 129.2, 18 R; 226/113, 114, 158; 139/224 A; 112/285, 279, 186, 231, 277, 181

[56] References Cited

U.S. PATENT DOCUMENTS

| | | | |
|---|---|---|---|
| 2,781,790 | 2/1957 | Hutchins | 139/136 |
| 3,509,840 | 5/1970 | Rovin | 242/118.4 X |
| 3,575,217 | 4/1971 | Pfarrwaller | 139/452 |
| 3,580,444 | 5/1971 | Van Mullekom | 139/452 |
| 3,582,796 | 6/1971 | Shifflet, Jr. | 328/69 |
| 3,628,129 | 12/1971 | Riley | 328/69 X |
| 3,628,480 | 12/1971 | Van Ness | 112/181 |
| 3,740,588 | 6/1973 | Stratton et al. | 328/69 X |
| 3,832,960 | 9/1974 | Mayer et al. | 112/279 X |
| 4,002,130 | 7/1977 | Rovin et al. | 112/186 X |
| 4,117,789 | 10/1978 | Rovin et al. | 112/186 |

*Primary Examiner*—Werner H. Schroeder
*Assistant Examiner*—Andrew M. Falik
*Attorney, Agent, or Firm*—Mandeville and Schweitzer

[57] ABSTRACT

Thread-loading apparatus for loading a bobbin spool with a predetermined length of thread between sewing operations wherein there is a reciprocal loading tube arranged to receive and draw thread from a package of thread, deliver its leading end to the bobbin and project it onto the bobbin while the latter is being rotated at a high speed so as to be caught thereby and wound onto the bobbin; a slack-producing device for drawing a slack length of thread from the package of thread preparatory to a loading operation to thus eliminate the inertial resistance of the package of thread to giving up thread; a precisely-controlled thread measuring device employed to control the length of thread delivered to the bobbin; and a bobbin having peripherally-spaced flexible fingers on its hub for entraining the leading end of the thread delivered to the bobbin. The apparatus, in one form, comprises a loading tube which is arcuately reciprocal toward and from the loading position and, in another, a loading tube which is rectilinearly reciprocal toward and from the loading position.

37 Claims, 33 Drawing Figures

90
91
92
93
14
22
31
45
44
24
42
47
46
27
28
75
25
23
26
32
21
29
35
30
34
33
36
37
40
94
96
95
93
92

FIG.15
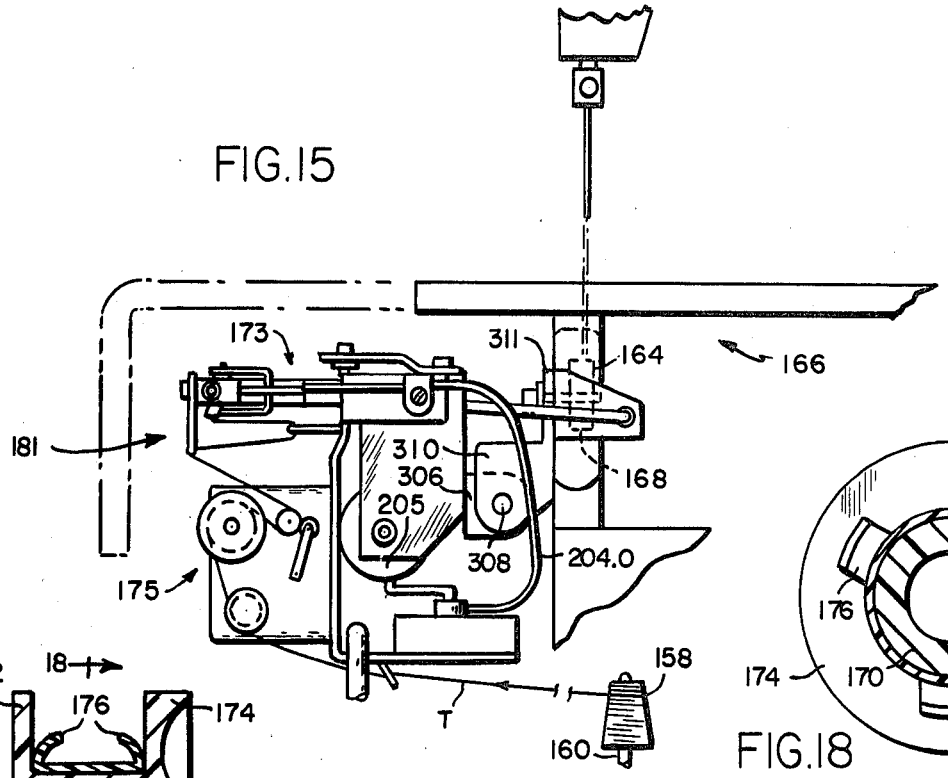
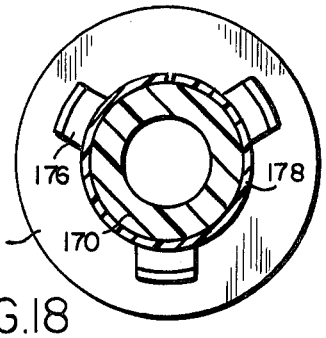
FIG.18
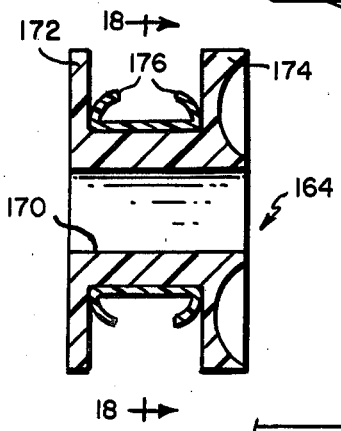
FIG.17
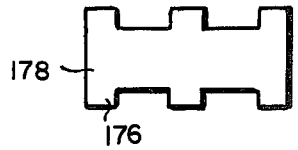
FIG.19
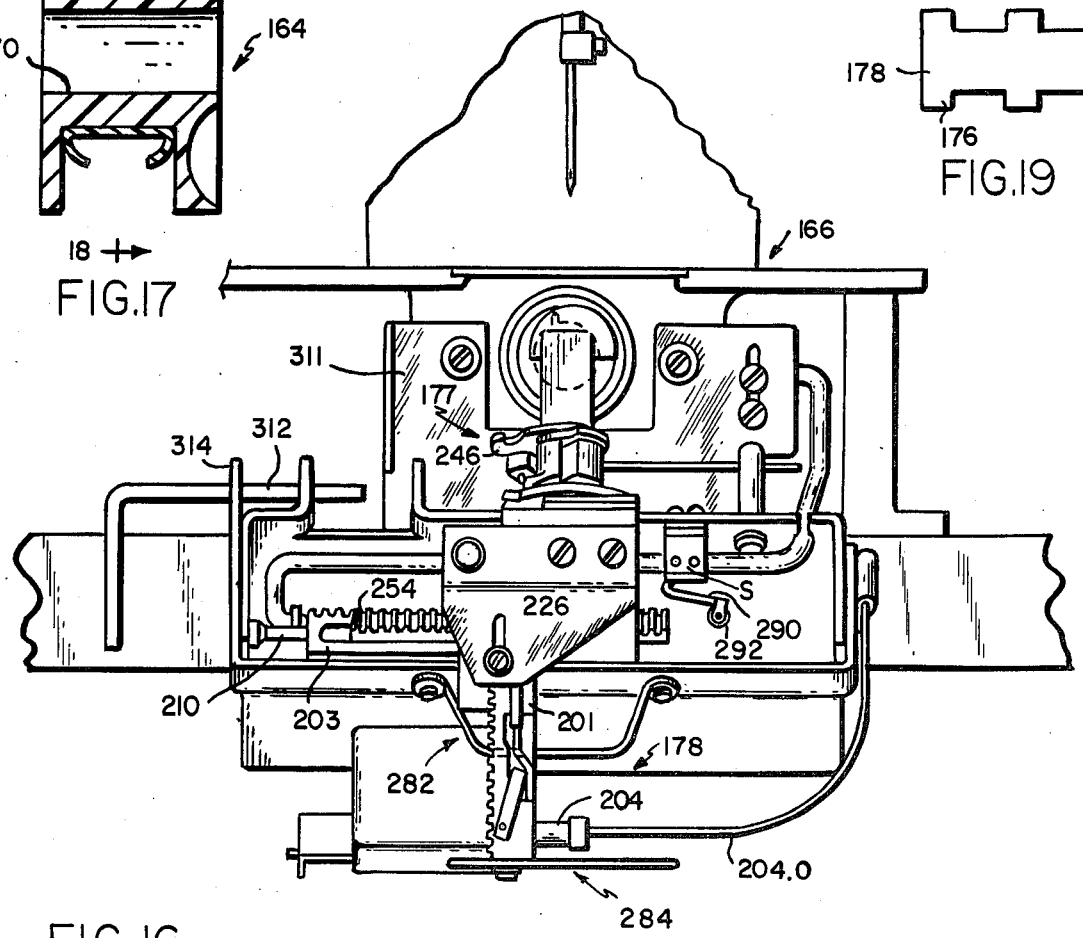
FIG.16

AUTOMATIC, IN SITU BOBBIN SPOOL LOADING

BACKGROUND OF THE INVENTION

This is a continuation-in-part application of Ser. No. 833,178, filed Sept. 14, 1977, entitled AUTOMATIC, IN SITU BOBBIN SPOOL LOADING now U.S. Pat. No. 4,117,789.

In U.S. Pat. No. 3,509,840, Rovin, May 5, 1970, there is shown bobbin loading apparatus wherein a loading device withdraws thread from a package of thread, delivers the leading end to a loading position adjacent a bobbin case within which there is a bobbin and projects the leading end into the case onto the bobbin for winding thereon. The bobbin is rotated at a high rate of speed by an air jet and has on its hub thin wires arranged parallel to its axis of rotation for trapping the leading end of the thread. There is a thread measuring device for measuring the thread as it is taken up by the bobbin and, when a predetermined length has been wound onto the bobbin, the loading device is retracted, the thread engaged with a tensioning finger on the bobbin case and cut. The bobbin loading apparatus of this application embodies improvements over that of the aforesaid patented structure in the loading device and means for effecting its reciprocal movement of which there are two forms; a thread measuring device which provides for more accurate control of the thread length; a bobbin spool which has improved tractive means for entraining the leading end of the thread; and especially in a slack-producing means designed to pull a slack length of thread from the thread package in readiness for each successive loading operation.

SUMMARY OF THE INVENTION

In accordance with this invention in its various aspects, there is provided, in combination with reciprocal loading means for receiving and transporting thread to a rapidly rotating bobbin for winding of a predetermined length of thread on the bobbin, slack-producing means for withdrawing a slack length of thread from the package of thread prior to each loading operation. In one form, operation of the slack-producing means is effected by the reciprocal movement of the thread loading means by relative movement of a part which is stationary with respect to the reciprocal thread loading means and a part which is movable therewith about which the thread is entrained on its way from the package of thread to the thread loading device. To ensure that the thread is pulled from the package of thread and not from the thread loading device, a clamp is provided for clamping the thread to the thread loading device during retraction of the latter. Alternatively, the slack may be provided for by a single part fixed relative to the reciprocating loading device over which the thread is led to the loading device. As a further alternative, the slack-producing device may be independent of the reciprocal movement of the thread loading device and in one form may be a wire held adjacent the thread path from the thread package to the loading device and means for moving it transversely with respect to the path at the termination of any loading operation to withdraw the thread while the latter is clamped at the one end to the thread loading device. The measuring device comprises a measuring wheel about which the thread is entrained which is rotated by the movement of the thread as it is drawn from the package of thread by the thread loading device which measures the exact length of thread drawn from the package for winding onto the spool and applies a brake to the thread to prevent further unwinding. Simultaneously, it initiates retraction of the thread loading device so that the slack-producing device will be effective, and partially releases the brake to allow the thread to be drawn from the package of thread. The partial release of the brake is effected during the early part of the retraction of the thread loading device. Near the end of each loading operation, the thread is frictionally engaged with a spring finger on the bobbin case by a thread manipulation device and, while held clamped to the thread loading device at the one end and at the bobbin case at the other end, is cut off close to the loading device. The loading device is a hollow elongate tube through which the thread passes supplied with a stream of air which serves, when the clamp is released, to project the leading end of the thread from the forward end of the tube through a hole in the bobbin case onto the rapidly rotating bobbin. In one form, the feed tube is reciprocated arcuately about a fixed center relative to the bobbin case and, in another form, is movable rectilinearly relative to the bobbin case. The bobbin in one form has peripherally of its hub a piece of material, the surface of which is fuzzy such as Velcro. In one preferred form, there are mounted on the hub peripherally-spaced flexible fingers which extend radially from opposite ends of the hub toward each other.

The invention will now be described with reference to the accompanying Figures, wherein:

FIG. 15 is an elevation of an alternative form of loading machine as seen from one side in relation to the frame of a conventional sewing machine;

FIG. 16 is an elevation of the loading machine of FIG. 15 as seen from the left side thereof tipped forwardly and downwardly from the sewing machine frame;

FIG. 17 is an elevation of a preferred form of bobbin spool;

FIG. 18 is a section taken on the line 18—18 of FIG. 17;

FIG. 19 is a plan view of the traction element which is applied to the hub of the bobbin;

Figure 1:
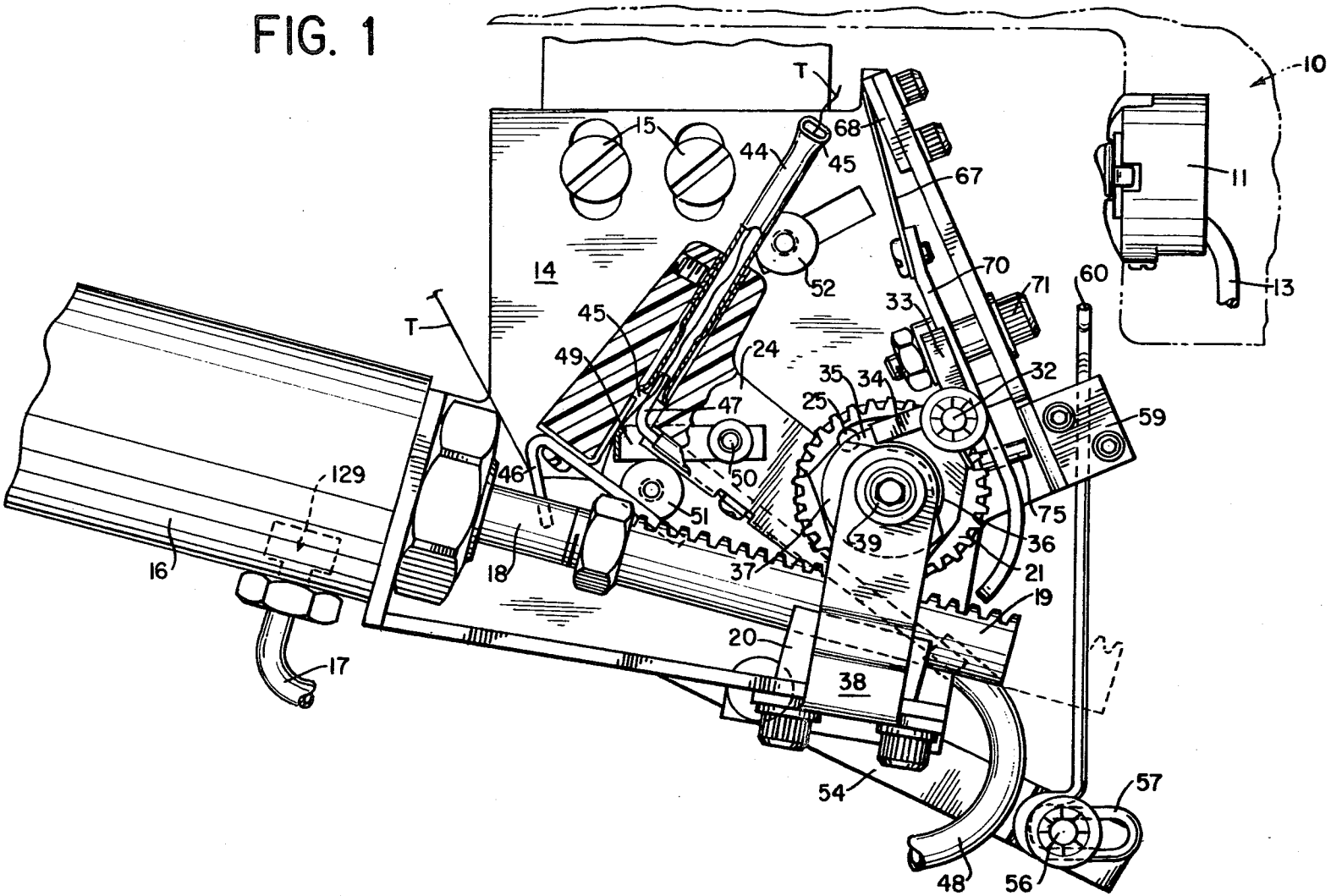
FIG. 1 is a side elevational view, with parts broken away, of an automatic, in situ bobbin, one form of loading mechanism according to the present invention.
Figure 2:
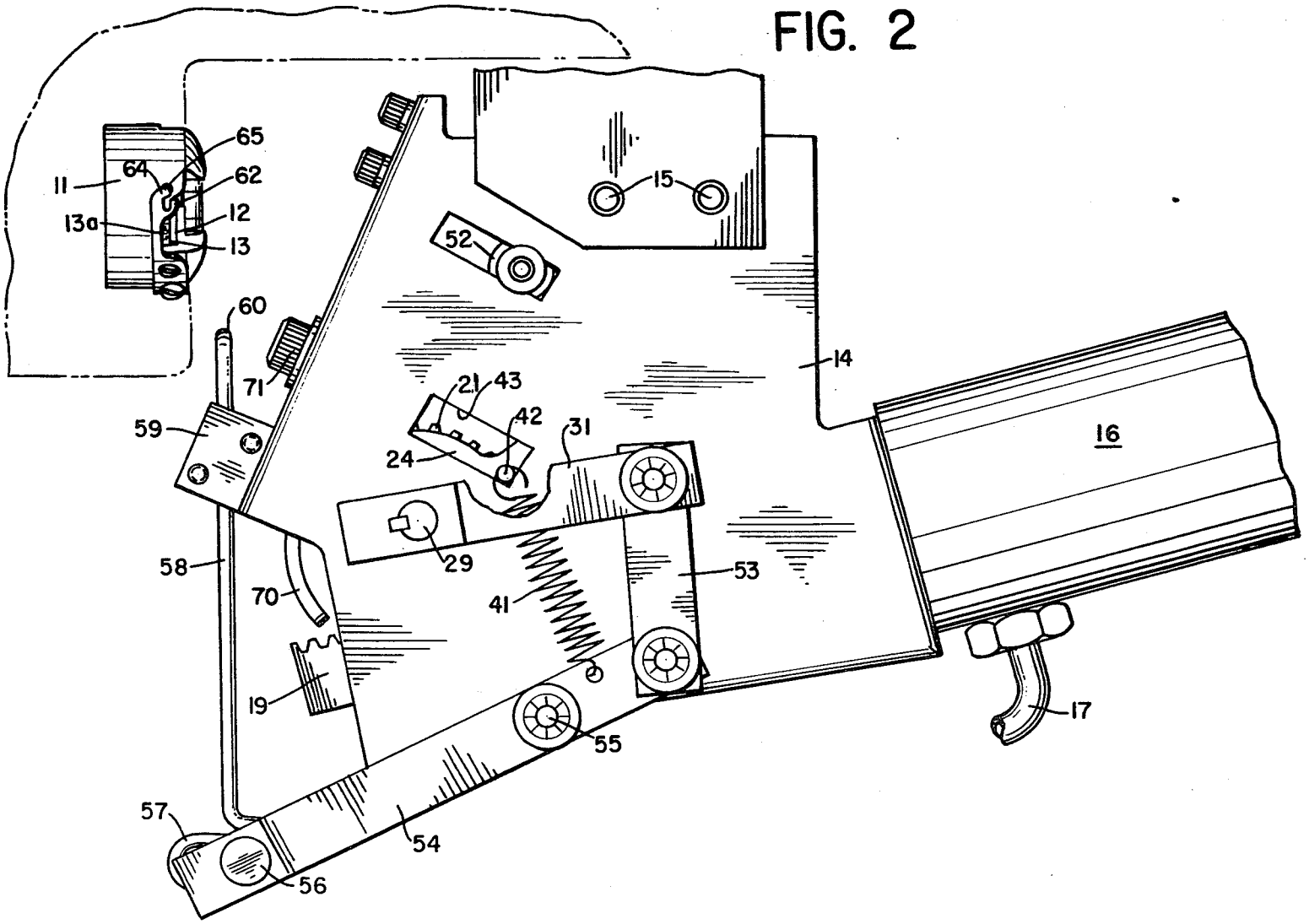
FIG. 2 is an elevational view of the mechanism of FIG. 1 taken from the opposite side thereof.
Figure 7:
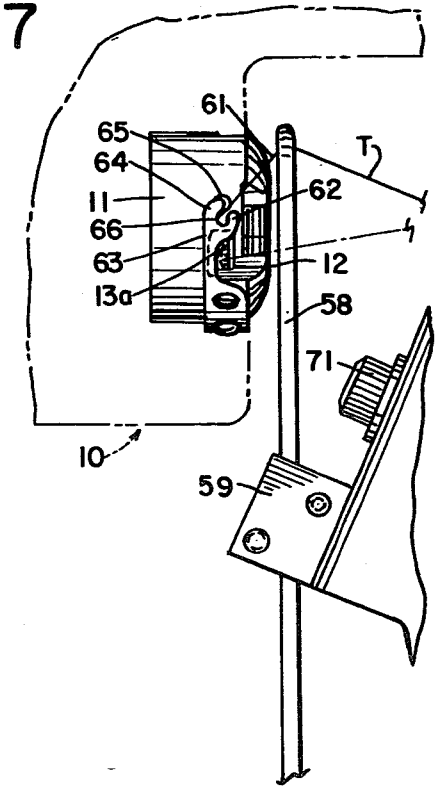
FIG. 7 is a fragmentary end elevational view of the mechanism in the position shown in FIG. 6.
Figure 6:
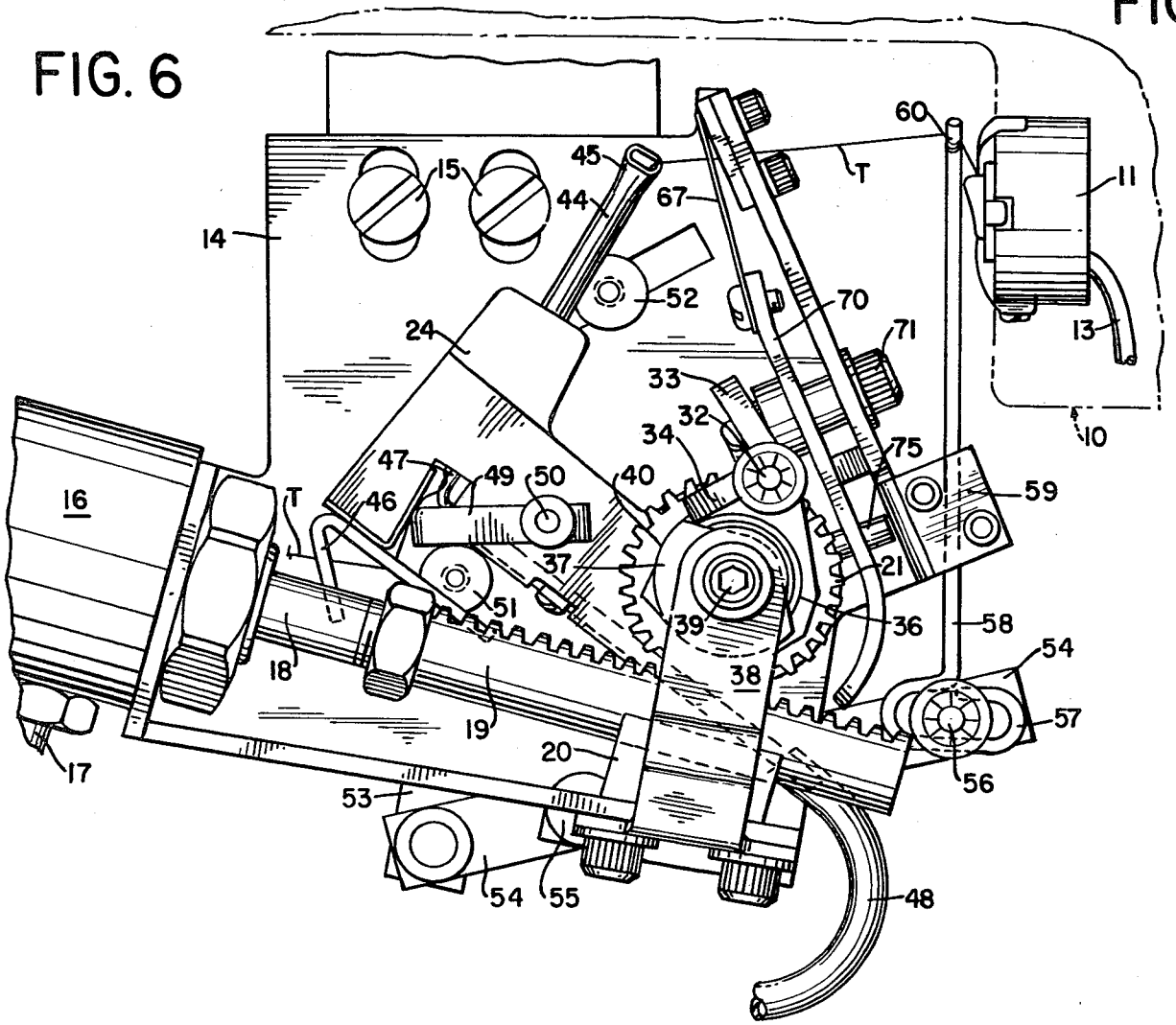
FIG. 6 is an elevational view, similar to FIGS. 1 and 5, illustrating the mechanism immediately after loading of thread onto a bobbin spool, with the thread being manipulated into position under the tension spring.

Referring to the drawings, and initially to FIG. 1, the reference numeral 10 designates in a general way a lock stitch type sewing machine of a generally conventional, commercially-available type. The sewing machine 10 includes appropriate means for mounting a bobbin case 11, containing and rotatably supporting a bobbin spool 12 (FIG. 2). Apart from its conventional function of retaining a small supply of bobbin thread, the spool 12 is constructed in accordance with teachings of the Rovin '840 patent, to include an end surface structure forming turbine blades, enabling the bobbin to be rotated at high speed during bobbin reloading operations, by the discharge of high velocity air against the end face of the spool, through a conduit 13. On the hub of the spool, provisions are made for entangling engagement with the leading end of a thread injected toward the hub of the rotating spool. To advantage, this may be achieved by providing on the hub a layer of a "fuzzy" material 13*a* (FIG. 7). A small piece of Velcro brand fastening material may be appropriate for the purpose.

In the form of the device illustrated in FIG. 1, the bobbin case 11 is mounted for rotation on a horizontal axis. However, in machines in which the bobbin is mounted for rotation on a vertical axis, the loading mechanism may be reoriented, so that the relationship of the mechanism to the bobbin axis remains generally the same.

The loading mechanism in one form is mounted by a bracket 14 to the sewing machine frame by appropriate mounting means (not shown) and has limited adjustability through screws 15 to achieve proper alignment with respect to the bobbin case 11. The bracket 14 mounts a spring retracted air cylinder 16, which may be of a conventional, commercially-available type provided with a built-in air valve operable automatically at the commencement of its retracting stroke to admit the flow of air through a discharge tube 17, for purposes to be described. Such air flow is subsequently terminated at the end of the extending stroke of the cylinder.

Mounted on the end of the actuator rod 18 is a rack 19, which is guided and supported in a slide bearing 20 and is arranged to mesh with a drive gear 21. As reflected best in FIG. 4, the drive gear 21 is mounted for rotation on a sleeve 22 rigidly mounted on and extending through the bracket 14. The sleeve 22 mounts, in addition to the drive gear 21, a timing disk 23 and a loading arm 24. The gear, disk, and arm all freely rotate on the sleeve 22 and the operation thereof is controlled primarily by the rack 19 in conjunction with a return spring. Thus, a pin 25 on the timing disk is received in an arcuate slot 26 in the drive gear, providing for the disk to be driven by the gear, subject to lost motion action provided by the elongated slot 26. Similarly, the loading arm 24 carries a pin 27 which is received within an elongated arcuate slot 28 in the timing disk.

Journaled within the sleeve 22 is a rock shaft 29 mounting a rocker plate 30 at its outer end. The rock shaft 29 extends through the sleeve, to the opposite side of the mounting bracket 14, and is keyed to a lever arm 31, whose function will be later described.

Figures 4, 10, 11:
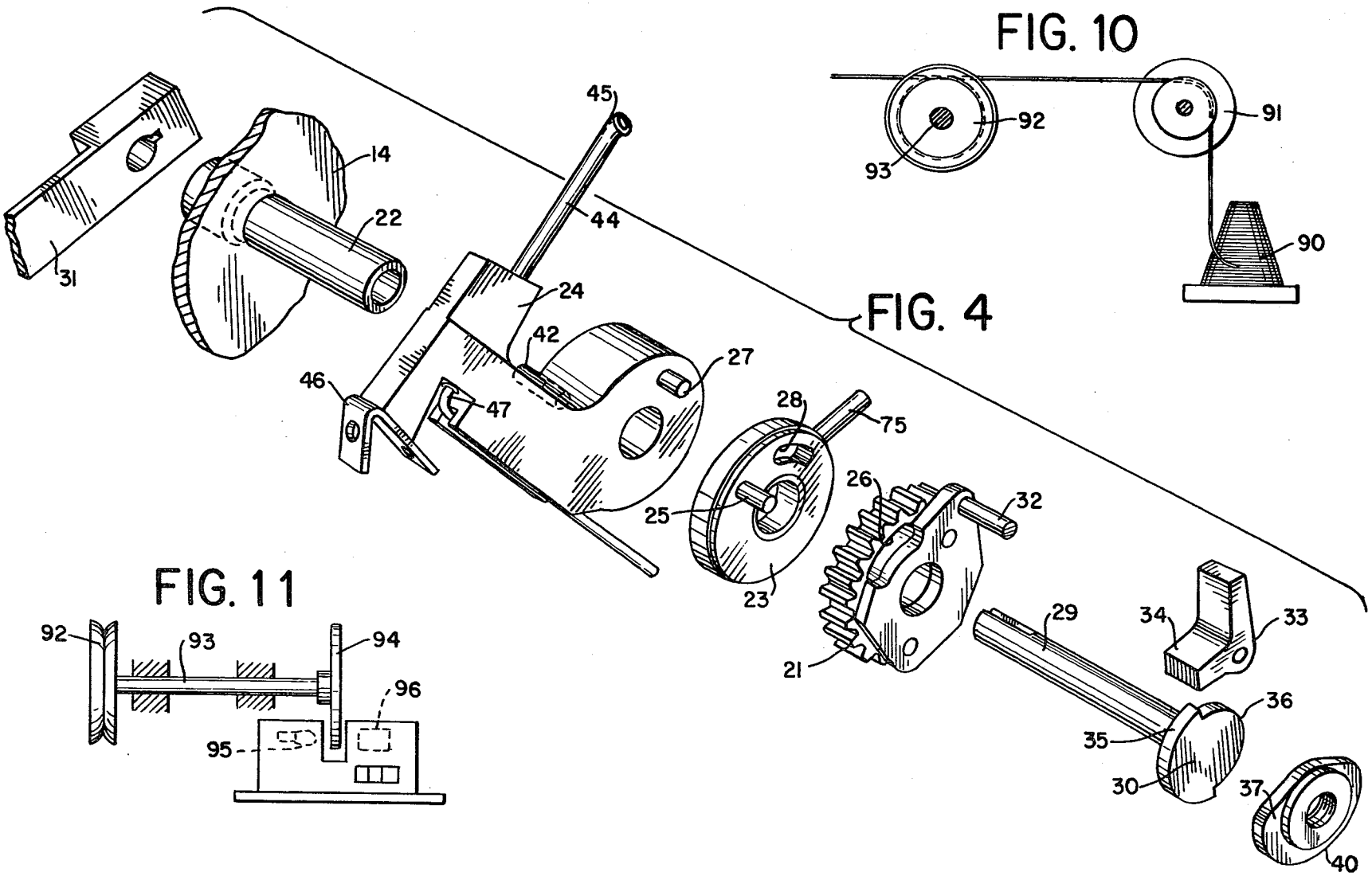
FIG. 4 is an exploded, perspective view of a sequential operation mechanism, forming a subassembly of the mechanism of FIG. 1.
FIGS. 10 and 11 are schematic illustrations showing an arrangement for the supply of thread to the bobbin loading mechanism, through a braking device and measuring wheel for controlling the length of the thread supplied.

As shown best in FIG. 4, the drive gear 21 carries a pin 32 on which is mounted a drive pawl 33. A torsion spring (not shown) urges the pawl 33 to rotate in a counterclockwise direction, tending to cause the drive arm 34 of the pawl to bear against the edge of the rocker plate 30. Thus, when the drive gear 21 is rotated first in clockwise direction, and then in a counterclockwise direction, the drive arm 34 of the pawl is carried beyond a shoulder 35 on the rocker plate and drops down onto the lower surface 36 thereof. Upon return rotational movement of the drive gear 21, in a counterclockwise direction, the rocker plate is engaged and driven by the pawl 33.

Figure 3:
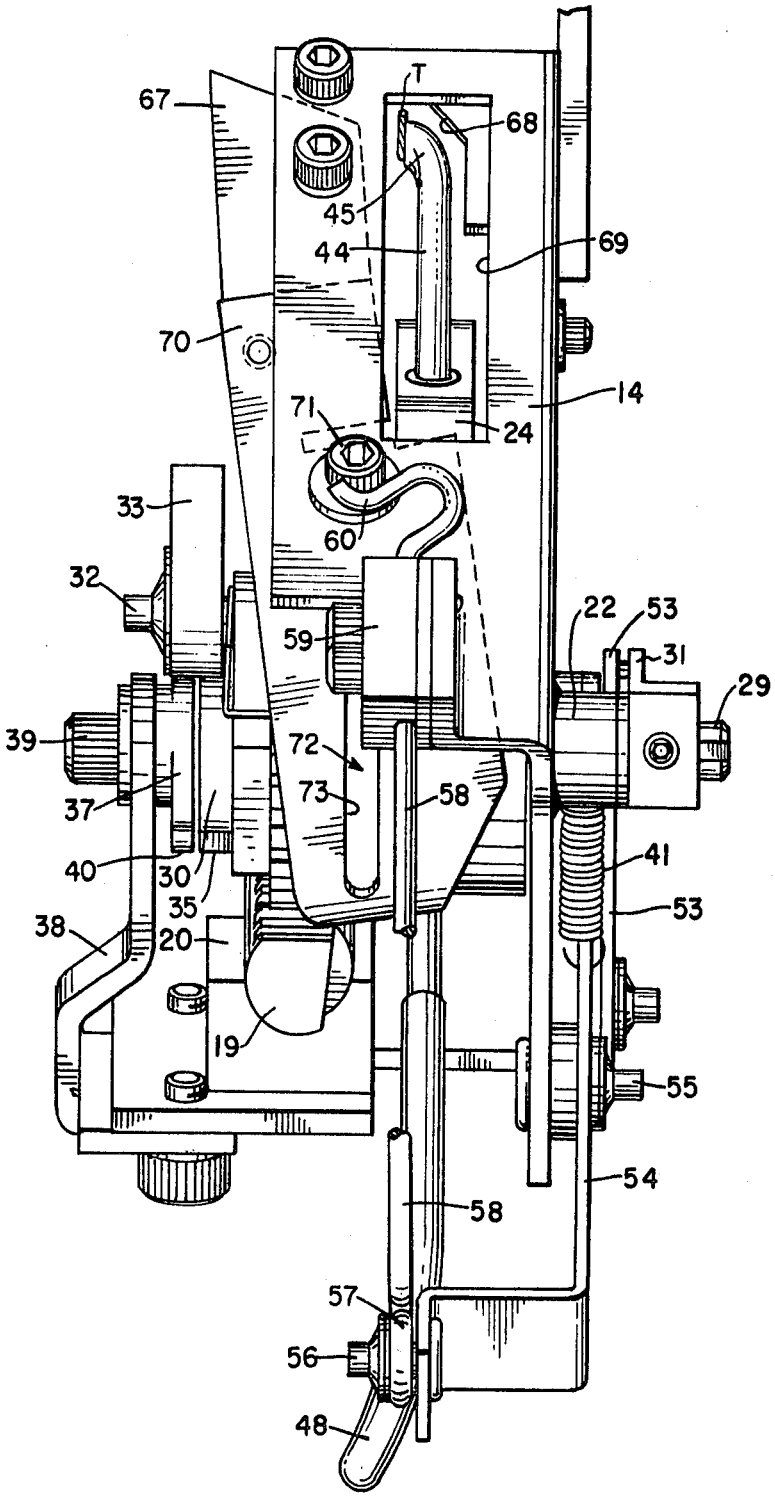
FIG. 3 is an end elevational view of the mechanism of FIG. 1.

As shown best in FIG. 3, the pawl 33 is positioned to overlie the rocker plate 30 and also a control cam 37. The cam 37 is rigidly but adjustably secured to a bracket arm 38, by means of a screw 39, such that the control cam 37 is positioned directly opposite the end of the rocker plate 30. The control cam 37 has a lifting surface 40 (FIG. 4) which functions to raise the pawl arm 34 progressively, as the pawl is carried in a counterclockwise direction by the drive gear, so that ultimately the rocker plate 30 is released after being driven a short distance by the pawl.

Figure 5:
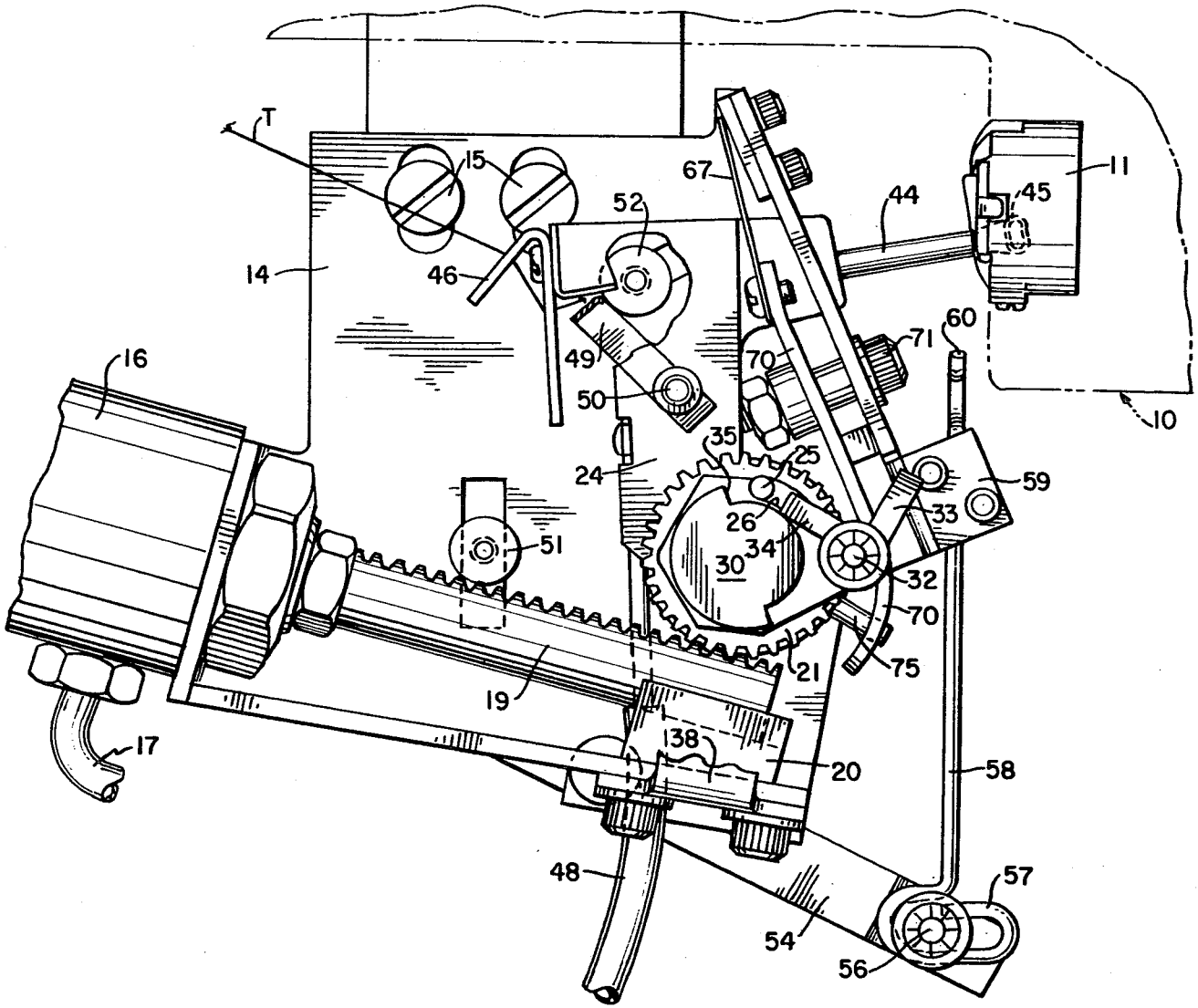
FIG. 5 is an elevational view, similar to FIG. 1, with parts of the mechanism shown in position for loading thread onto a bobbin spool.

At the initiation of a bobbin loading sequence, the actuator 16 is energized to retract the rod 18, rotating the drive gear 21 through a predetermined angle in a clockwise direction. At the commencement of this motion, the loading arm 24 initially is held in a counterclockwise retracted position, by means of a return spring 41 (FIG. 2) located on the back side of the mounting bracket 14 and engaging a pin 42 carried by the loading arm and extending through a slot 43 in the bracket. When driven in a clockwise direction, the drive gear 21 rotates for a short distance until the timing disk 23 is picked up, and the gear 21 and disk 23 then rotate together for a further short distance until the loading arm is picked up. Thereafter, the gear, disk and arm rotate together throughout the balance of the retracting stroke of the cylinder rod. When the actuator has completed its retracting stroke, the loading arm 24 will have been pivoted to a position shown in FIG. 5 in which a hollow loading tube 44, carried by the loading arm, projects into a cutout opening (not shown) in the side of the bobbin case 11. The bent-around end extremity 45 of the loading tube is then facing the hub area of the bobbin spool, in position to discharge thread directly at the bobbin spool for entangling engagement with the spool hub.

As shown particularly in FIG. 1, the loading tube 44 is seated within a tubular passage 45 in the loading arm and is arranged to receive a thread T extending from a bulk source (not shown) through a thread guide 46, into the passage 45 and through the loading tube. The loading tube is sufficiently large at its inlet end to receive with clearance a small air discharge tube 47. The tube 47 communicates through a flexible line 48 and pressure reducing valve (not shown) with the actuator-valved air supply line 17. The arrangement is such that, upon initiation of the retracting motion of the actuator rod, low pressure air is supplied through the loading tube, urging the thread to advance through the tube. At the same time, high pressure air is directed through the tube 13 for driving the bobbin spool at high speed.

The fully extended position of the actuator rod 18 is generally as indicated in broken lines in FIG. 1. During the initial retracting movement of the actuator rod, to the position shown in full lines in FIG. 1, the loading arm 24 remains stationary. There is no movement of the thread through the loading tube during this interval, because the thread is clamped in the loading arm by means of a clamping lever 49 pivoted at 50 on the loading arm and pressed against the thread by a stop lug 51 carried by the mounting bracket. As the actuator rod moves to its fully retracted position, shown in FIG. 5, the loading arm 24 is quickly brought into a loading position, where thread end is directed by the air flow from the loading tube 44 onto the hub of the bobbin spool, which is rotated at high speed. When the loading arm 24 is in its active or loading position, indicated in FIG. 5, the brake lever 49 is pressed into a thread-releasing position by means of a second stop lug 52 mounted on the bracket. Once the thread end extending from the loading tube 44 is entrained by the fuzzy material in the bobbin or entangled by the fuzzy material in the hub, the high speed rotation (e.g., several thousand rpm) of the bobbin spool serves to wind thread onto the spool in an extremely short time. By means of control circuit arrangements to be described hereinafter, the supply of a predetermined length of the thread T onto the bobbin spool executes a control function which serves to stop the thread T by means of a solenoid-actuated brake, and initiates a reverse movement of the actuator rod 18.

During the reverse or extending movement of the actuator rod 18, the following functions are performed in sequence. The loading arm and tube are withdrawn from the bobbin case, the thread is reclamped in the loading arm, the intact thread extending from the loading tube to the bobbin spool is manipulated to bring the thread under a tension spring on the bobbin case, and the thread is then severed between the loading tube and the bobbin case, to permit a new sewing sequence to commence. It should be understood, in this respect, that the entire series of actions involved in the retraction and extension of the actuator rod 18, and the performance of all the operations involved in the reloading of the bobbin, occur within a very short time, less than a second in most instances.

When extending movement of the actuator rod is commenced, the drive gear 21 is rotated in a counterclockwise direction. Although the relationship of the pins 25,27 to their respective arcuate slots 26,28 in the drive gear and timing disk does not result in positive driving of the loading arm 24, the latter is nevertheless returned to its initial position by the action of the return spring 41. The thread T remains under tension, being gripped by a solenoid at the bulk supply end and being held under stalled torque of the bobbin spool, which is still influenced by the turbine air discharge. When the loading arm 24 reaches its starting position, the clamping lever 49 engages the stop lug 51, and the thread is firmly clamped in the loading arm.

Approximately at the time that the loading arm reaches its starting position, the driving arm of the pawl lever 33 engages the shoulder 35 of the rocker plate. Continued counterclockwise rotation of the drive gear 21 thereupon causes counterclockwise rotation of the rock shaft 29 and pivoting of the rocker arm 31. This continues for perhaps 10° or so of rotation of the drive cam, until the riser surface 40 lifts the drive arm 34 off of the shoulder 35. The rocker arm 31 and shaft 29 are then returned to their initial positions by the return spring 41, as will appear.

Connected to the rocker arm 31, by means of a connecting link 53, is a lifting lever 54, which is pivoted at 55 on the primary mounting plate. At its outer end, the lifting lever 54 carries a pin 56 which is slidably associated with an elongated eye 57 formed in a generally vertically-disposed thread manipulating wire 58. The wire 58 is slidably guided in a bearing block 59 and has an upwardly-opening hook portion 60 at its upper end which underlies the path of the thread extending between the bobbin case 11 and the retracted feed tube 44. As reflected in FIGS. 2, 3 and 5, for example, the initial position of the upper end of the manipulating wire is initially below the bobbin case 11. During the extending stroke of the actuator rod 18, when the rocker arm 31 is pivoted through its arc of rotation, the lifting lever 54 is pivoted upwardly, carrying the hook-like upper end 60 of the manipulating wire upward into contact with the thread T and thence upward further a short distance, to displace the thread upwardly. At this juncture, the thread is clamped in the loading arm and is being held by the stalled bobbin spool, such that the thread is maintained under at least limited tension. Accordingly, when the thread is displaced upwardly by the manipulating wire 58, the portion 61 of the thread which is adjacent the bobbin case 11 is carried underneath a pressure finger 62 formed on a bobbin thread tension spring 63. Opposite the pressure finger 62 is a limiting tab 64, which projects into an opening 65 in the side wall of the bobbin case, and serves as a positive stop against further upward movement of the bobbin thread. After the bobbin thread has been displaced above the pressure finger 62, and then released by subsequent downward movement of the manipulating wire 58, the thread is confined to a narrow bite 66 in the end of the tension spring 63, being pressed against the side wall of the bobbin case by the pressure of the spring, in order to provide the desired bobbin thread tension.

As will be appreciated from the foregoing description, the rocker arm 31 is both displaced and subsequently released for return movement while the drive gear continues to rotate unidirectionally in a counterclockwise manner. Return motion of the rocker arm is achieved by engagement of the return spring 41 with the inner end of the lifting lever 54 (FIG. 2).

After manipulation of the thread into its operative position under the tension spring 63, the thread is severed between the loading tube 44 and the bobbin case 11. In the illustrated apparatus, this is accomplished by means of a cutting knive 67 which cooperates with a cutting edge 68 carried by the mounting bracket 14. As illustrated particularly in FIG. 3, the mounting bracket 14 has an opening 69 which receives the loading tube 44 and through which the thread T passes in extending from the loading tube to the bobbin spool. The cutting blade 67 is mounted on the end of a cutting arm 70, which, in turn, is pivoted on the mounting bracket 14 by means of a mounting screw 71.

Figures 8, 9:
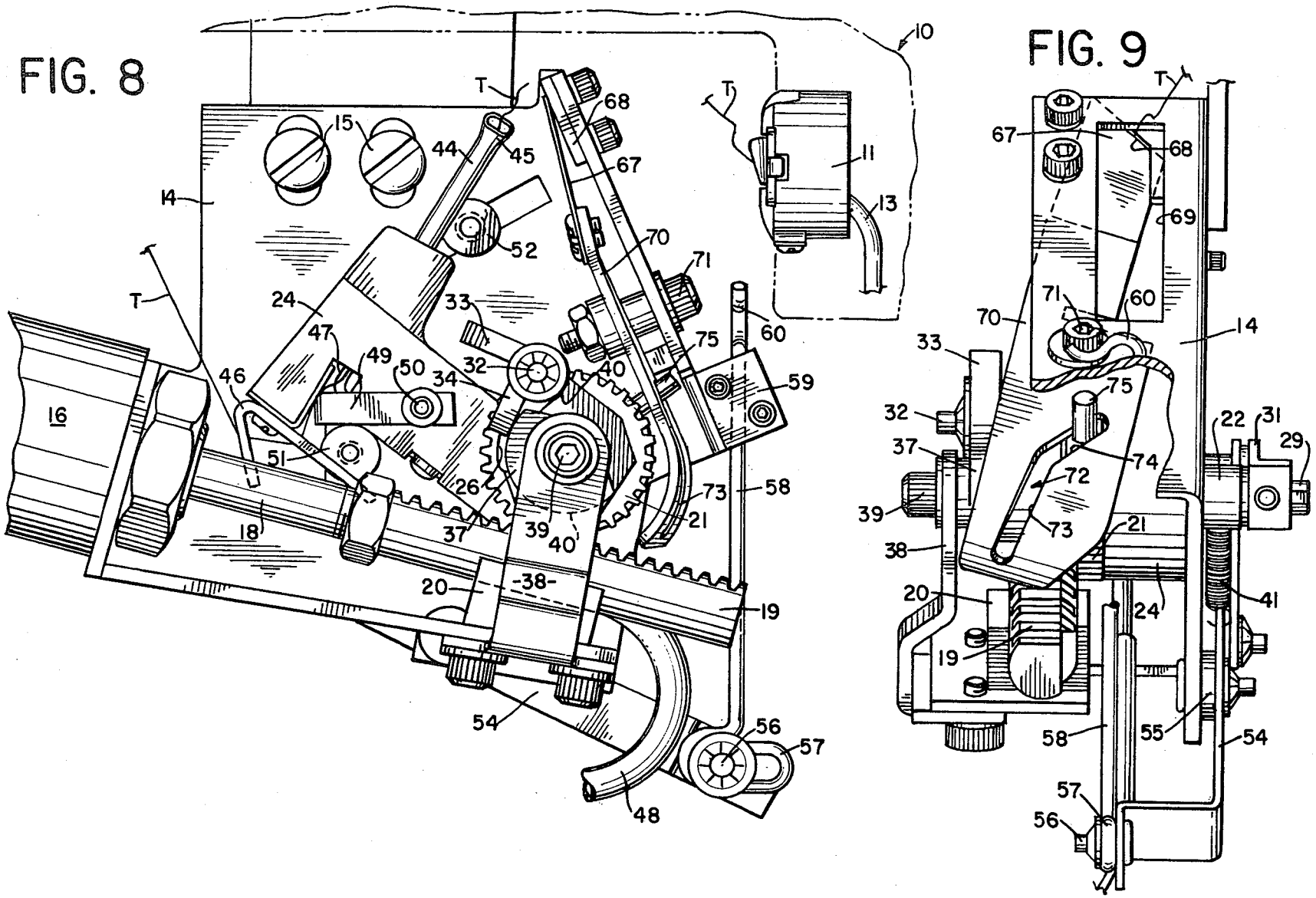
FIG. 8 is a further sequential view of the mechanism, shown in side elevation, immediately after cutting of the thread following a loading operation.
FIG. 9 is an end elevational view of the mechanism in the position shown in FIG. 8.

As reflected particularly in FIG. 9, the lower end of the cutting arm 70 is provided with an elongated cam slot 72, including a vertical lower portion 73 and an angularly disposed upper portion 74. The cam slot is of an appropriate size to closely receive a camming pin 75 extending radially from the timing disk 23. The arrangement is such that the movement of the cutting blade 67 is controlled by rotation of the timing disk 23.

During the retracting stroke of the actuator rod 18, clockwise rotation of the timing disk 23, without movement of the cutter arm 70, is accommodated by the vertical portion 73 of the cam slot. In other words, the rotational movement of the pin 75 does not effect lateral displacement of the cutting arm. Subsequently, during the extending movement of the actuator rod, the pin 75 first travels upwardly in the lower portion 73 of the cam slot. During this interval, the loading lever 24 is being retracted and the thread manipulating wire 58 is being actuated to place the intact thread under the bobbin tension spring 63. Thereafter, during continued counterclockwise rotation of the drive gear and timing disk, the camming pin 75 enters the angularly disposed upper portion 74 of the cam slot and displaces laterally the lower portion of the cutting arm 70, as reflected in FIG. 9. This brings the cutting blade 67 into shearing relation with the cutting bar 68 to sever the thread.

More or less simultaneously with the severing of the thread, the actuator rod 18 reaches the limit of its extending movement, closing the cylinder-contained air valve and terminating the flow of air to the turbine nozzle tube 13 and to the feeding tube 44. The mechanism holds in the just-described portion as sewing proceeds, and is reactivated at the end of sewing of the next work unit, either automatically, or on the manual signal of the machine operator, more typically the former.

Of critical importance in the loading of the bobbin spool 12 is to assure the loading of a sufficient length of thread to enable the sewing of a given work unit to be completed, so as to avoid second-quality product or, in some cases, the need for removing the partially-completed sewing and reperforming the sewing operation. While this may be accomplished effectively by providing for substantial excess, this, too, is to be avoided, because it can represent a surprisingly large economic loss in a highly repetitive operation. To this end, the system of the present invention includes a simplified and economical, yet highly precise and effective circuit arrangement for measurement of the thread length, as it is being fed on the spool during a loading operation. In this respect, the control arrangements of the present invention differ from those of the before-mentioned Rovin '840 patent, in which a length of thread to be loaded on a spool is premeasured in advance of the loading operation. We have found it preferable to measure the thread length as it is being delivered onto the bobbin spool, in order to avoid an accumulation of slack thread in the supply system.

Figure 12:
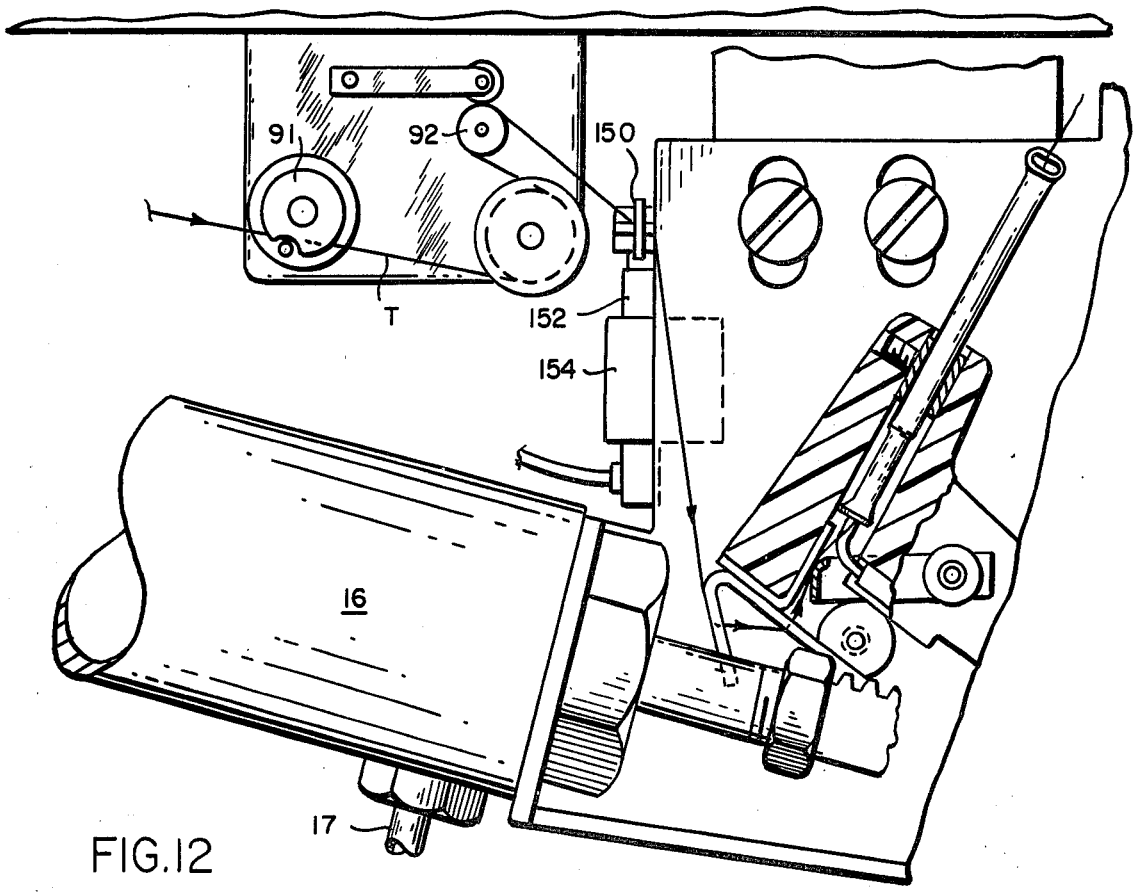
FIG. 12 is a side elevational view like FIG. 1 showing the provision of one form of slack-producing device for providing a slack length of thread at the thread-loading mechanism.

The control system of the invention is reflected in FIGS. 10–12 of the drawings. In FIG. 10, a bulk thread supply is designated by the reference numeral 90, and this may be in the form of a standard cone, for example. The thread is guided through a solenoid-actuated brake 91, and then is given a full turn around a measuring wheel 92, after which the thread is guided appropriately to the loading arm 24 of the feeding device. When thread is being wound onto the bobbin spool 12, the measuring wheel 92 is, of course, rotated in proportion to the linear advance of the thread.

The measuring wheel 92 desirably is of lightweight construction, to be as free as practicable of inertia. The wheel is mounted on a shaft 93 which also carries a uniformly slotted disk 94, the slotted edge of which operates in an area between a light source 95 and a photoelectric receptor device 96. Accordingly, the photoelectric receptor device is pulsed according to the number of slots passing the light source, which, in turn, is a direct function of the linear advance of the thread. By appropriate measurement of the number of such pulses, the increments of thread fed to the bobbin spool during a loading operation may be accurately measured and controlled.

While, theoretically, precise measurement of the thread increment may be achieved by merely counting the number of pulses generated by the photoelectric sensing device 96, standard counting circuits suitable for that purpose, and including provisions for a wide range of adjustment of the thread increment, are more costly than can be justified for the application involved. It is to be understood, in this respect, that the system of the invention, like any automation system, is commercially advantageous only to the extent that savings in material and time adequately exceeds capital and maintenance costs, making cost increment in the manufacture of the system a vital concern as regards the commercial utility thereof. Accordingly, pursuant to the present invention, a novel and advantageous circuit arrangement is provided, as illustrated in FIG. 14 which is advantageously cost effective and which provides for accurate, adjustable control of thread length in the loading operation.

Figure 14:
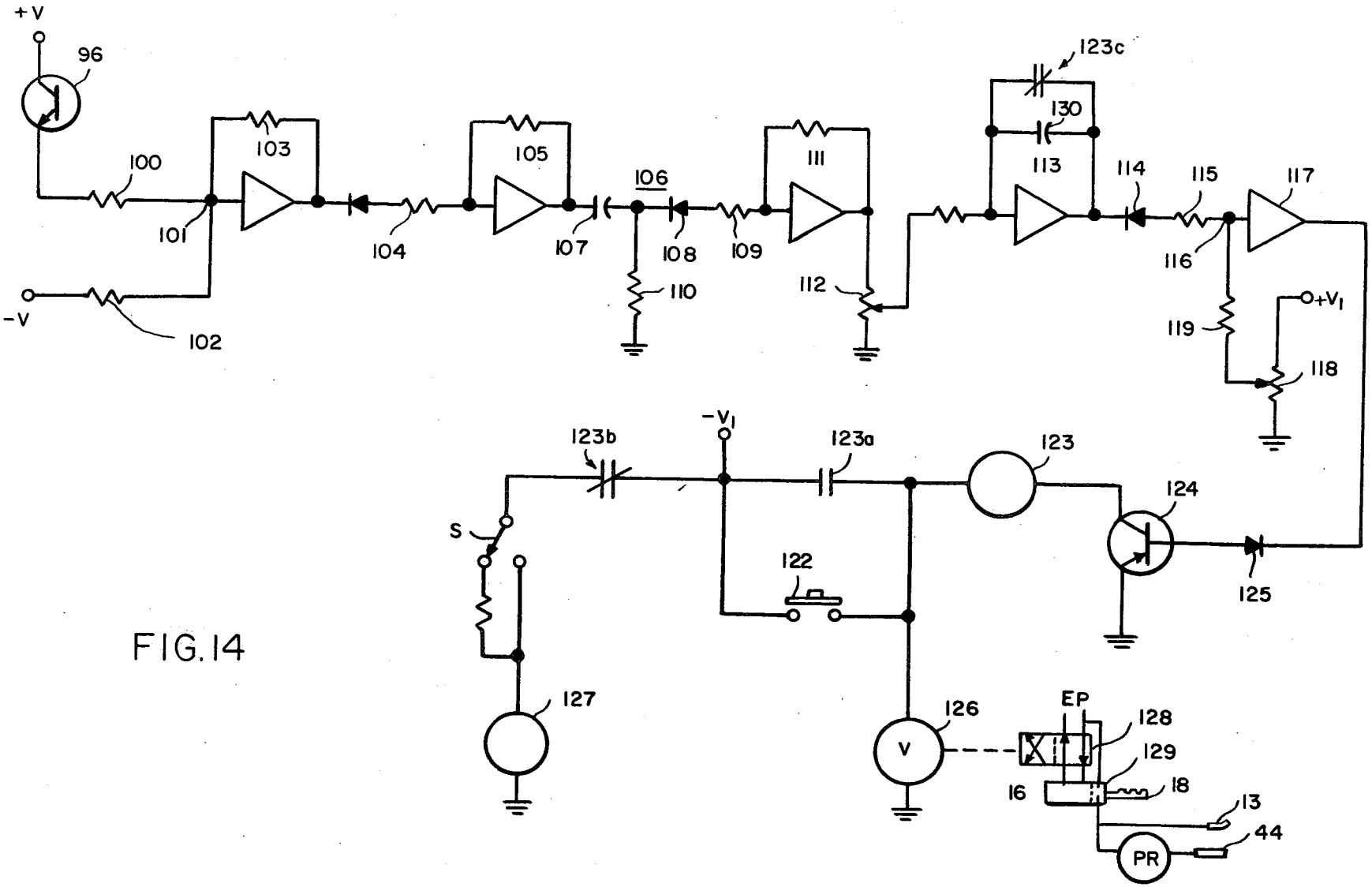
FIG. 14 is a simplified, schematic representation of a novel and advantageous form of control circuit utilized for precisely controlling the length of thread.

With particular reference now to FIG. 14, the photoelectric sensing device 96 is connected at one side to a source of positive control voltage +V and at its other side to a voltage summing junction 101, through a resistor 100. Voltage generated by the photoelectric device 96, when exposed to successive pulses of light, is unidirectional, varying between a minimum positive voltage when light does not fall upon the device, and a greater positive voltage when the device is energized by a light pulse. Accordingly, a source of negative voltage −V is connected to the summing junction 101 through a resistor 102. The arrangement is such that the voltage at the summing junction will go through a polarity charge with each pulse, swinging from negative to positive each time the device 96 is energized by a light pulse.

In the course of a thread loading operation, the slotted disk 94 rotates at varying threads, due in part to the fact that the measuring wheel must go through an acceleration phase when thread movement commences. Accordingly, the signal pulses generated at the summing junction 101 will vary both as to amplitude and as to pulse width. For accurate pulse measurement, the circuit arrangement of the invention provides means for converting these variable pulses into pulses of consistent form, breadth, and amplitude, which may be conveniently and accurately integrated. For this purpose, the signal input at the junction 101 is directed through a relatively high-gain amplifier, which drives the pulse into a form approaching that of a square wave. The output of the first stage amplifier 103 is a signal of reversing polarity, and this signal is passed through a blocking diode 104 and then into a second high-gain amplifier 105. The second stage amplifier further drives the unidirectional pulses into greater conformity with the square wave form, providing signals with sharp, well-defined fronts. The pulse output of the second stage amplifier 105 thus has a substantially constant form factor and a constant amplitude, but may vary in width as a function of the rotational velocity of the slotted disk 94.

The output of the second stage amplifier 105 constituting variable width, unidirectional pulses, is fed into a further pulse-forming network 106, comprising a capacitor 107, diode 108 and resistor 109 connected in series, with a resistor 110 being connected to ground from the junction between the capacitor 107 and diode 108. This pulse-forming network serves to create a pulse whose width is substantially constant over the range of frequencies encountered as a result of speed variation in the slotted disk 94. The output of the pulse-forming circuit 106 thus is a unidirectional pulse of square form, having a uniform amplitude and width. This pulse is then fed through a further amplitude 111 to increase its energy content, and then is passed through a calibrating potentiometer 112.

The adjusted signal from the calibrating potentiometer 112 is supplied to an integrating circuit 113 which accumulates the signal pulses, developing an incrementally increasing output voltage as a direct function of the number of input pulses. The integrator 113 is conventionally arranged, including a DC operational amplifier with capacitor feedback. The output of the integrator circuit 113 is fed through a blocking diode 114 and resistor 115 to a summing junction 116 forming the input to an extremely high-gain amplifier 117. The integrated voltage signal thus supplied is of negative polarity. A positive voltage signal is also applied to the summing junction 116 from a voltage source +V, a potentiometer 118 and line resistor 119. The potentiometer 118 provides a positive comparison voltage, to be compared with the negative voltage output of the integrator 113.

Initially, the output of the high-gain amplifier 117 is highly negative, inasmuch as the input voltage is primarily the positive voltage from the adjustable control potentiometer 118, the amplifier serving to invert the voltage polarity. During a thread loading operation, the voltage input through the amplifier 117 becomes progressively less positive, as successive increments of negative voltage are added to the output of the integrator circuit 113. At a predetermined point, corresponding to the loading onto the bobbin spool of the desired number of linear increments of thread, the voltage at the summing junction 116 becomes slightly negative, and the output of the high-gain amplifier 117 switches from negative to sharply positive, becoming stable in the positive condition.

At the commencement of a thread loading operation, a starting switch 122 is momentarily closed, either manually or by an appropriate automatic control function on the sewing machine. An energizing circuit is completed through the coil 123 of a control relay, through a transistor 124 to ground. The transistor 124 is conductive at this time, by reason of the negative output voltage of the amplifier 117, applied through blocking diode 125 to the base electrode of the transistor. Upon energizing of the relay 123, holding contacts **123*a* thereof close, shunting the starting switch 122, and normally closed contacts 123*b* and 123*c*** are opened.

Closing of the starting switch 122 also energizes the solenoid 126 of an air valve 128, supplying actuating air to the rod end of the air actuator 16 to commence the mechanical aspects of the loading operation. Simultaneously, through opening of the contacts **123*b*, a solenoid 127, controlling the thread brake 91**, is de-energized to release the thread.

After its commencement, a thread loading operation will continue until the accumulated voltage output from the integrator circuit 113 equals the adjusted voltage from the control potentiometer 118, which has been preadjusted according to a desired thread length. When the voltage at summing junction 116 turns negative, the high-gain amplifier 117 becomes sharply positive, rendering the transistor 124 nonconductive and thus de-energizing the control relay 123. The following actions then take place: Relay contacts **123*a* open, de-energizing the air valve solenoid 126 and effecting a reversal of air flow to the actuator 16 such that pressure is applied to the head end of the actuator to extend the rod 18. Relay contacts 123*b* close, energizing the brake solenoid 127 and instantly stopping the movement of thread from the bulk supply. Pressure air continues to be supplied to the spool turbine nozzle 13 and to the loading tube 44, through the actuator-contained air valve designated 129 in FIG. 12. The valve 129 is closed when the actuator rod 18** has completed its extending stroke.

Simultaneously with the energizing of the control relay 123, a set of contacts **123*c* closes, shorting out the capacitor 130** of the integrator circuit. The integrator is thus discharged of its accumulated voltage and readied for a subsequent loading cycle.

A soft, loosely-spun thread will, in most instances, be pulled from the package of thread, moved to loading position, projected onto the rapidly rotating bobbin and wound onto the bobbin by the aforesaid loading tube.

Figure 13:
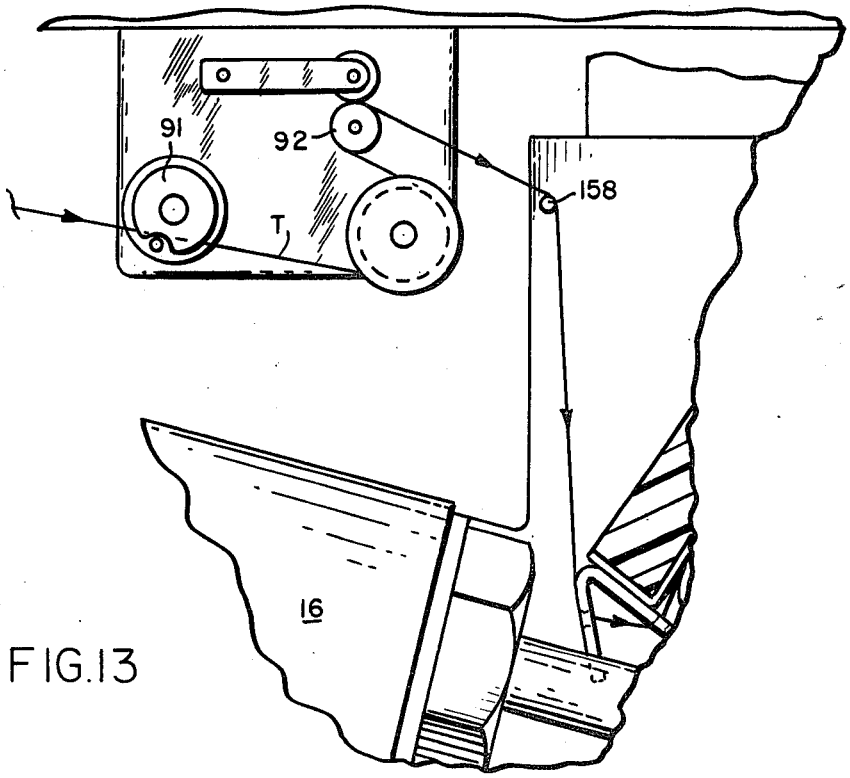
FIG. 13 is a fragmentary side elevational view showing another form of slack-producing device.

However, if the thread is hard, stiff or glossy, as many threads made of artificial fibers are, the flow of air through the loading tube may not be sufficient to overcome the inertial resistance of the movement of the thread and, hence, may fail to project the leading end of the thread through the opening in the bobbin case into the bobbin for winding thereon. Accordingly, it is desirable to provide a slack-producing mechanism for drawing a slack length of thread from the thread package so that there will be substantially no inertial drag on the thread as the loading tube is advanced toward loading position, which would tend to interfere with presenting the leading end to the spool. This is provided for in one form, as shown in FIG. 12, by leading the thread T from the thread package to the entrance end of the loading tube, through an eye 150 at the end of a plunger 152 reciprocally mounted in an air cylinder 154 which is actuated after the loading tube is returned to its retracted position to move transversely with respect to the thread path to pull a length of thread from the package of thread. This is made possible by the fact that the thread within the loading tube is clamped therein as it returns to its retracted position so that the only source for a slack length of thread is that of the package of thread. Alternatively, as shown in FIG. 13 and since the loading tube is pivotally reciprocal, it is possible to produce a sufficient slack length of thread by fixing a pin 158 in spaced relation to the normal course of the thread in its absence from the package to the loading tube in its retracted position so that the reciprocal movement of the loading tube will draw a slack length of thread from the package of thread. In this case, also, the slack is drawn from the package rather than from the loading tube because the thread is clamped to the loading tube early in the retractive movement of the loading tube toward its retracted position.

Because of the abrupt movement of the plunger 152 on the one hand and the loading tube on the other hand, too much thread may be pulled off the package of thread by the slack-producing means and, to avoid this, there is provided in the control circuit means for partially releasing the brake 91 which is applied to the thread to limit the length of thread wound onto the bobbin to a predetermined length so that the brake lightly resists withdrawal of the thread from the package of thread. The means employed for this purpose is a resistance R which is inserted into the coil of the solenoid which activates the brake by a double acting switch S.

Figure 23:
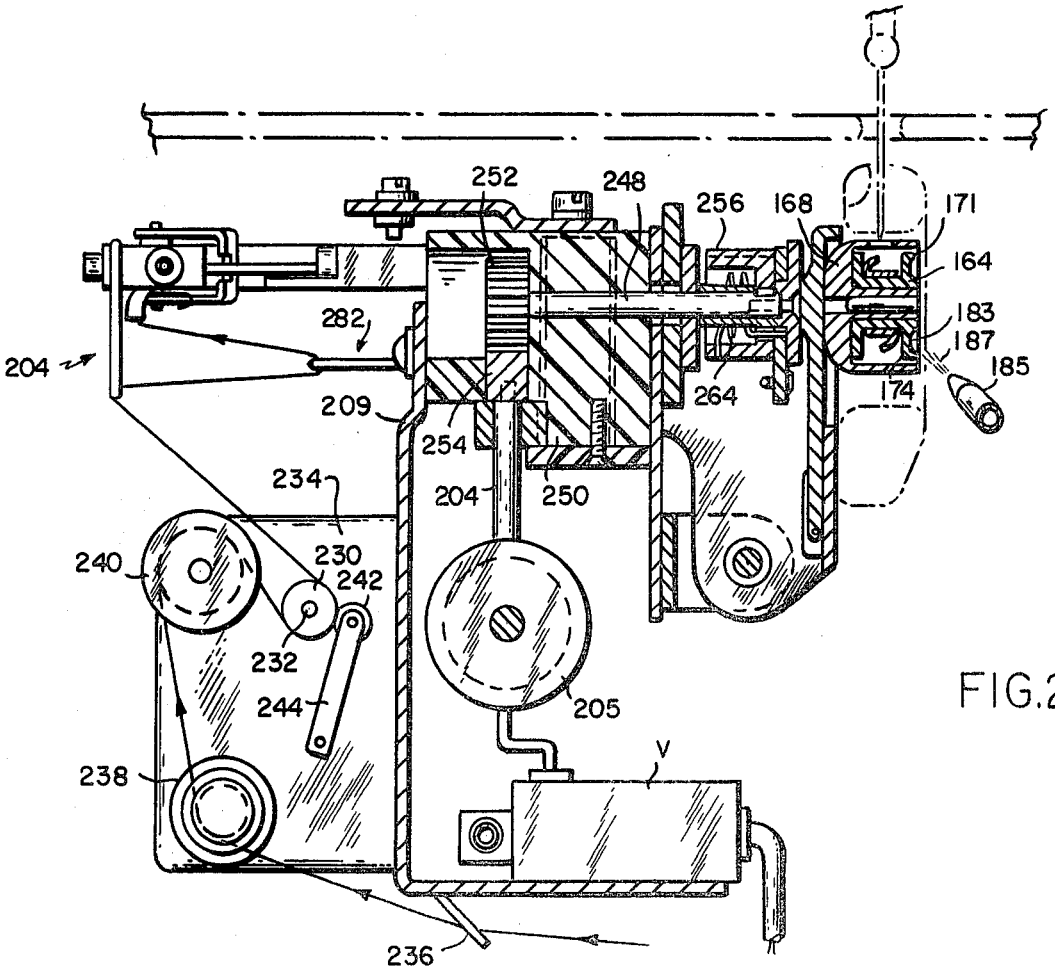
FIG. 23 is an enlarged side view like that shown in FIG. 15 with parts in section and particularly showing the bobbin spool of FIGS. 17 and 18 in the bobbin case.

An alternative loading mechanism is illustrated in FIGS. 15 to 33 inclusive wherein thread T is withdrawn from a package of thread 158 supported, for example, on a spindle 160 and transported by loading mechanism 162 to a loading position adjacent the bobbin case 168 of a sewing machine, a portion of which is indicated at 166 wherein the bobbin is supported in a bobbin case 168, FIGS. 15 and 23, for rotation about a horizontal axis. The bobbin may be of the kind earlier described provided with a piece of Velcro for catching the thread end. Preferably, a bobbin such as illustrated in FIGS. 17 and 18 is used wherein the bobbin 164 has on its hub portion 170 between its flanges 172,174 peripherally-spaced flexible fingers 176 which rise radially from the hub adjacent the inner sides of the flanges and slope inwardly therefrom toward each other. The friction-engendering means is made by longitudinally splitting a short length of gum rubber tubing to form a strip 178, FIG. 19, notching the strip 178 along its opposite sides to provide longitudinally-spaced protrusions which comprise fingers 176—176 at opposite sides and wrapping and securing the strip about the hub 170 of the bobbin. Due to the fact that the strip 178 was originally a tube, the distal ends of the fingers 176 at opposite ends of the hub tend to return to their initial tubular shape and, hence, curl away from the flanges toward each other. The fingers thus formed effectively entrain the leading end of the thread when the latter is projected against the rapidly rotating bobbin.

Rotation of the bobbin 164 is achieved, as also disclosed in the aforesaid patent, by the turbine blades 183 formed in the flange 174 of the bobbin and a nozzle 185 arranged to project a stream of air 187 against the turbine blades. The nozzle 185 is connected by means of a flexible tube 189 to a source of pressure not shown.

Figure 24:
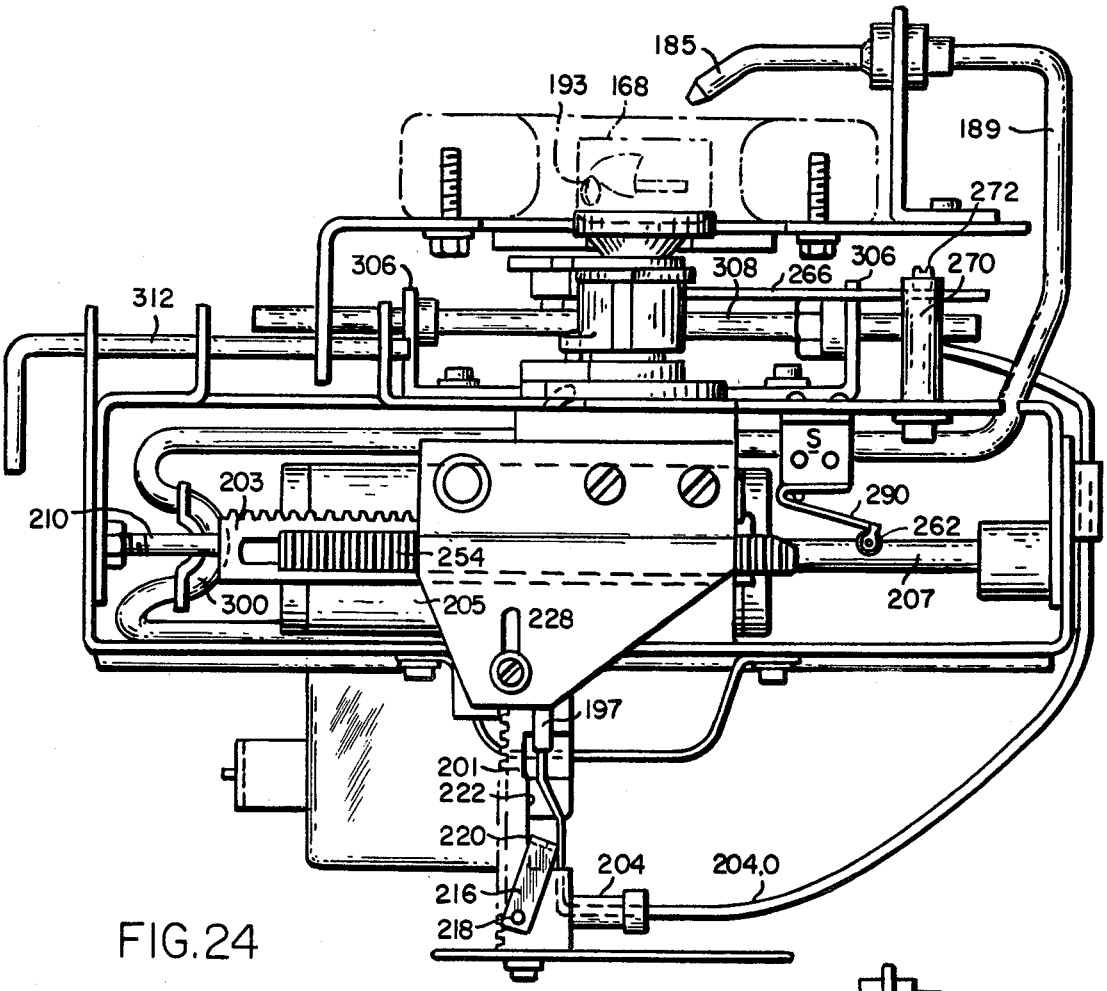
FIG. 24 is a plan view showing the mechanism in its retraction position ready to commence a cycle of operation.
Figure 25:
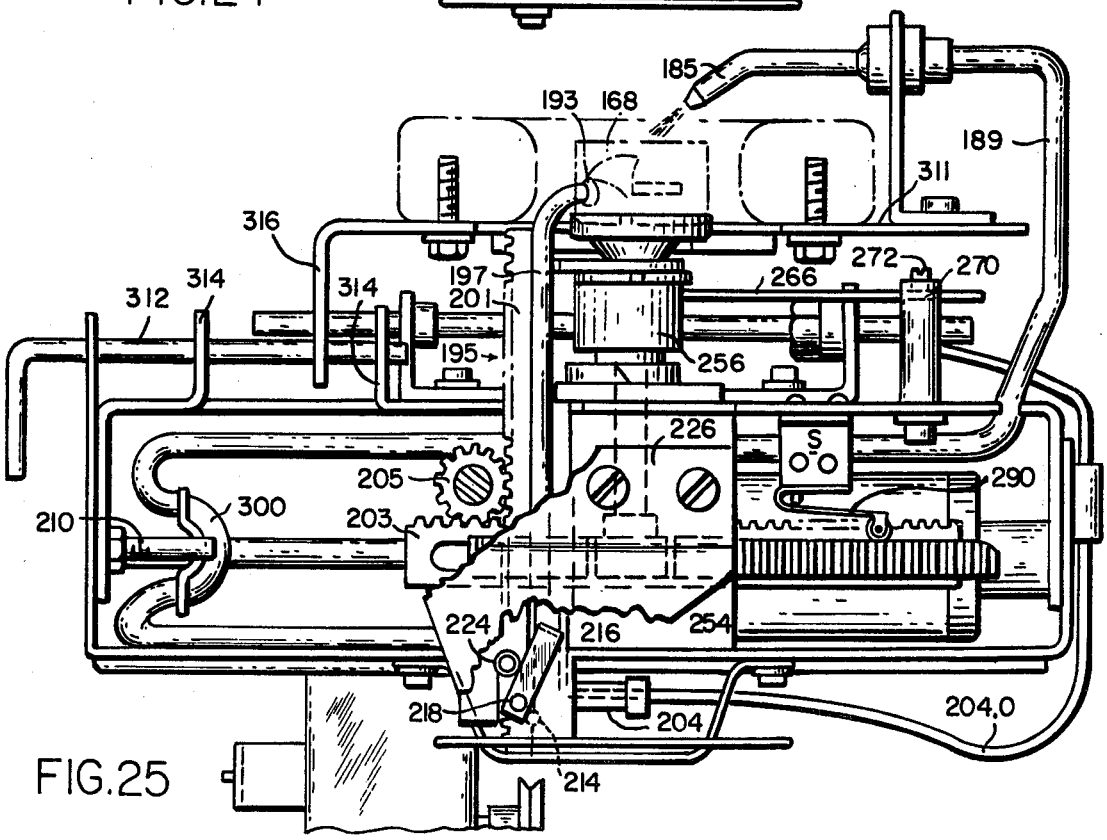
FIG. 25 is a view similar to FIG. 24 showing the mechanism in its loading position.
Figure 27:
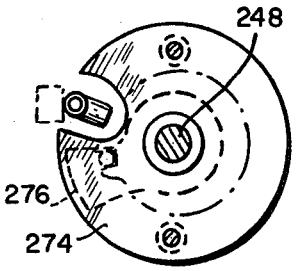
FIG. 27 is a view taken on the line 27—27 of FIG. 26.
Figure 29:
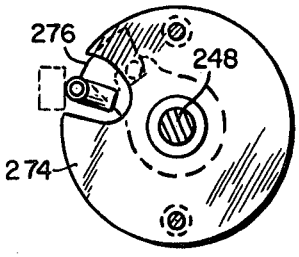
FIG. 29 is a view taken on line 29—29 of FIG. 28.

The bobbin case 168 contains an opening 193 receiving the leading end of the thread and the loading means 173 for transporting the thread to the bobbin case and for projecting its leading end through the opening 193 onto the rapidly rotating bobbin is a feed tube assembly 195 mounted for reciprocal movement relative to the bobbin case from a loading position adjacent the bobbin case, FIG. 25, to a retracted position, FIG. 24. The feed tube assembly 195 comprises a slender tube 197 which defines an elongate thread passage 200 attached as, for example, by welding to a rack bar 201, FIG. 22, supported for movement in a horizontal plane parallel to the axis of rotation of the bobbin. Reciprocal movement of the rack bar 201 provides for moving the leading end of the feed tube 197 from a loading position adjacent the bobbin case, FIG. 25, to a retracted at rest position, FIG. 24, between sewing operations. Reciprocal movement of the rack bar 201 is achieved by means of a rack bar 203 supported in a horizontal position transversely of the axis of rotation of the bobbin and a gear 205 supported for rotation about an axis at right angles to the rack bars 201 and 203 and in mesh with each of the rack bars 201 and 203. Reciprocal movement of the rack bar 203 is provided for by a cylinder 205 mounted for reciprocation in a horizontal plane transversely of the axis of rotation of the bobbin on a rod 207 fixed at its opposite ends to a mounting bracket 209 by means of which the entire loading mechanism is mounted to the front of the sewing machine as will be described hereinafter. The rod 207 has fixed to it internally of the cylinder a piston element 211 and the cylinder is supplied at its opposite ends through flexible conductors 213 and 215 connected by a solenoid-operated valve V to a source of air pressure which enables supplying air to the cylinder to effect reciprocation thereof.

The loading tube 197 defines a thread passage 200 which extends from end-to-end thereof for receiving the thread and transporting it to the bobbin case and to assist in such transportation and to eject the leading end of the thread from the end of the loading tube into the opening in the bobbin case onto the bobbin, there is provided within the loading tube an air tube 202 which is connected at the rear end of the rack bar 201 by way of a coupling 204 and flexible conductor 204.0 to a solenoid-operated valve V by means of which air may be supplied to the loading tube during its movement to the loading station.

Movement of the cylinder 205.0 is transmitted to the rack bar 203 by posts 204—204 rigidly fixed at their lower ends to the cylinder and extending upwardly therefrom through a slot 206 extending longitudinally of the rack bar 203, the length of the slot being greater than the distance between the posts, thus providing a lost motion connection between the cylinder and the rack bar which permits relative movement between the two. A coiled spring 208 connected at one end to the post 204 at the left end of the cylinder, FIG. 21, and at its other end to the stud 207 at the under side of the rack bar 203 holds the rack bar displaced with respect to the cylinder with the right end of the slot 206 engaged with the post 204 at the right end of the cylinder. A stop 210 fixed to the mounting bracket in alignment with the left end of the rack bar 203 limits its retraction so that the cylinder 205.0, because of the aforesaid lost motion, continues to travel to the left after the rack bar is brought to rest by the stop 210 a distance "a". This lost motion is taken advantage of to permit air to be delivered to the bobbin to bring it up to speed before the loading tube is moved to its loading position. The lost motion is also taken advantage of to effect tensioning of the thread and cutting thereof after the loading tube has been retracted.

Figure 26:
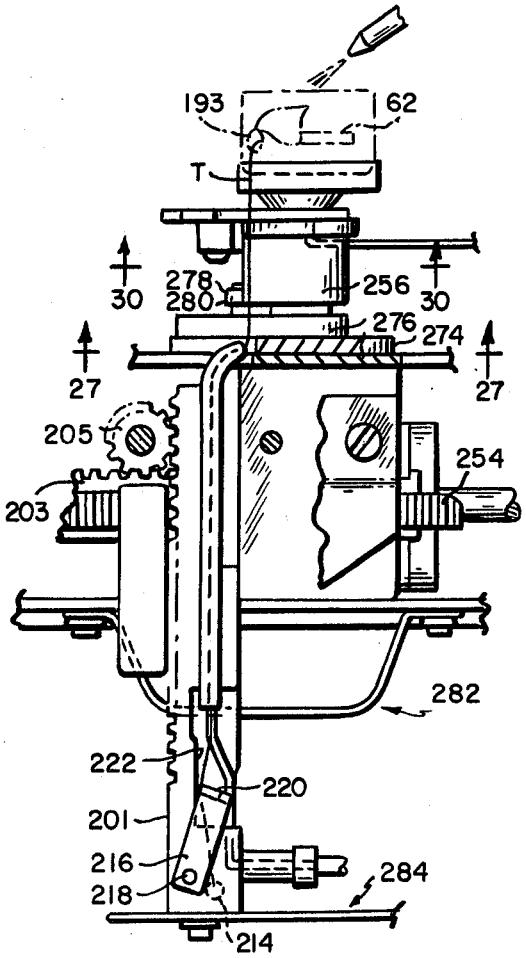
FIG. 26 is a fragmentary elevation illustrating an intermediate stage in the operation wherein the thread has been introduced into the bobbin casing and the loading tube withdrawn so as to enable cutting the thread.
Figure 28:
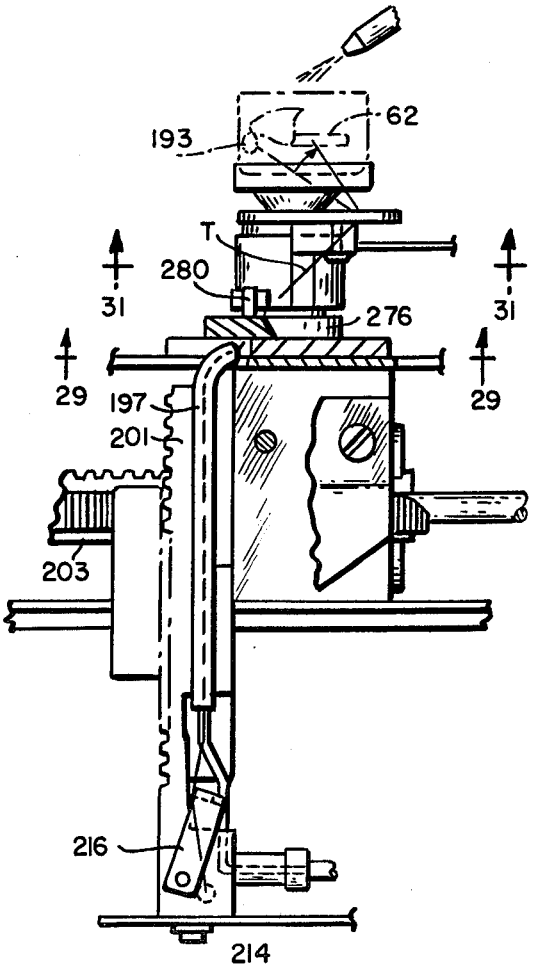
FIG. 28 is a view corresponding to FIG. 26 showing the mechanism at the intermediate stage of its operation wherein the loading tube has been withdrawn and the thread manipulating mechanism has been moved to a position to insert the thread beneath the tension finger of the shuttle case.
Figure 30:
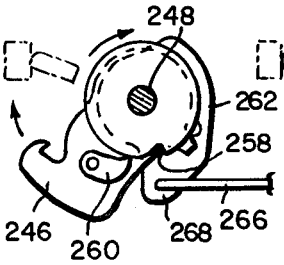
FIG. 30 is a view taken on the line 30—30 of FIG. 26 showing the retracted position of the thread manipulating mechanism.
Figure 31:
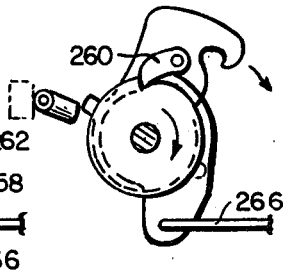
FIG. 31 is a view taken on the line 31—31 of FIG. 28 showing the thread manipulating mechanism engaged with the thread.
Figure 32:
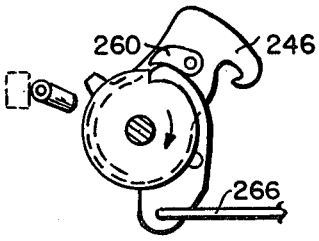
FIG. 32 is a view similar to FIG. 31 showing the release of the thread manipulating mechanism following movement of the thread under the bobbin case tensioning finger.
Figure 33:
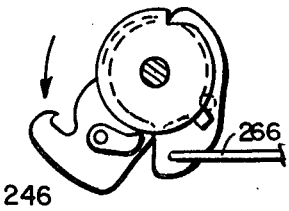
FIG. 33 is an elevation similar to FIG. 31 showing return to the thread manipulating mechanism to its initial position.

The thread from the thread package is led into the rear end of the loading tube 197 through an opening 214 in the rack bar 201, FIGS. 26 and 28, behind a spring-biased clamp member 216 pivotally mounted to the rack bar on a pivot pin 218 with its distal end 220 engaged with the bottom of a notch 222 formed along one side of the rack bar so that, unless held retracted, the clamp member 216 pinches the thread between it and the back of the notched portion of the rack bar, thus preventing movement of the thread within the loading tube. Hence, during the initial movement of the loading tube toward loading position, thread is caused to move with the loading tube by the clamping action of the clamp member. As the loading tube nears its loading position, the clamp member 216 is moved away from the bottom of the notch by a cam element 224, FIG. 25, adjustably supported on a cover plate 226 within a slot 228 which enables adjusting the position at which the clamp member will be disabled as the loading tube is moved toward the loading position and enabled as the loading tube is retracted. Release of the thread as the loading tube nears the loading position permits the thread to be projected by the air jet flowing through the loading tube from the leading end thereof through the opening in the shuttle case onto the rapidly rotating bobbin.

Figure 20:
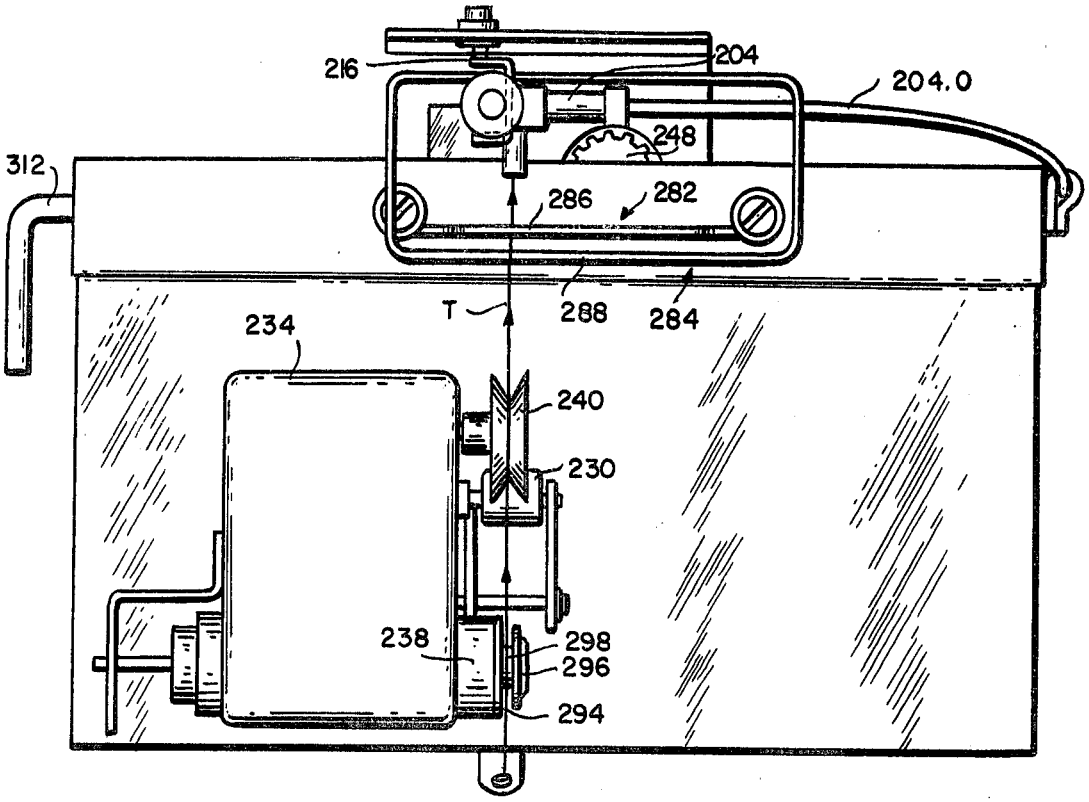
FIG. 20 is a front elevation to a larger scale with the loading machine in operative position.
Figure 21:
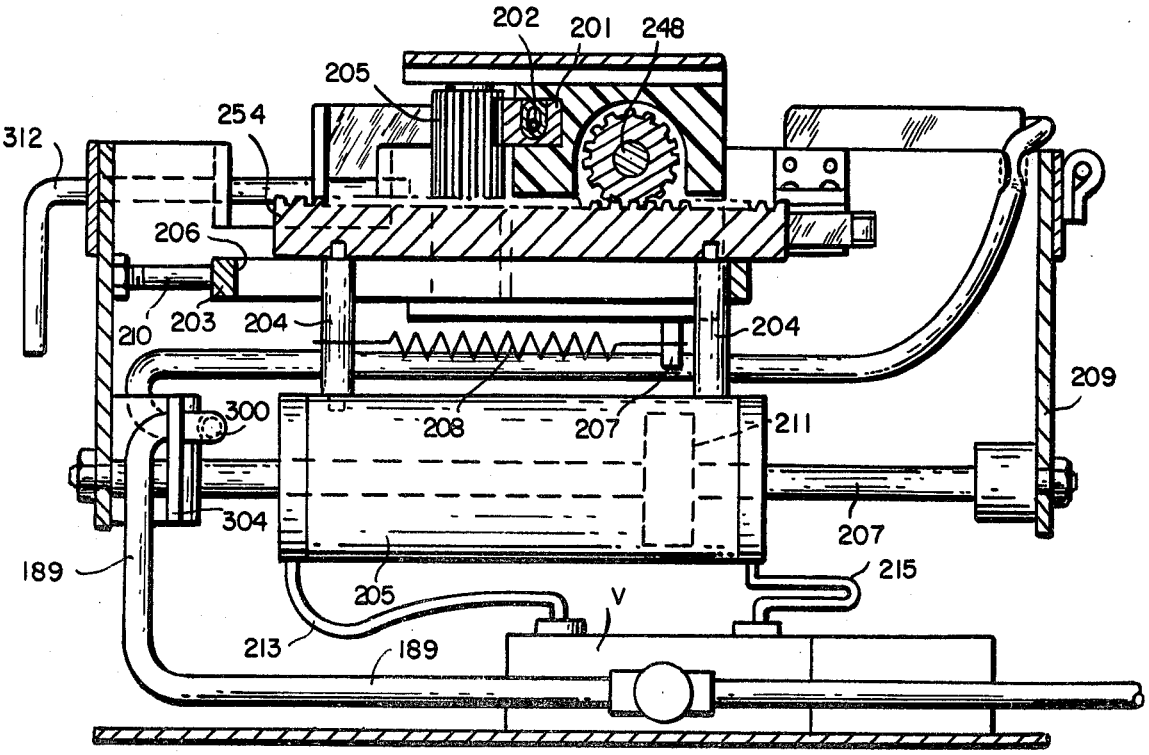
FIG. 21 is a view taken on the line 21—21 of FIG. 15 showing the drive means in an intermediate stage of operation between its loading position and retracted position.
Figure 22:
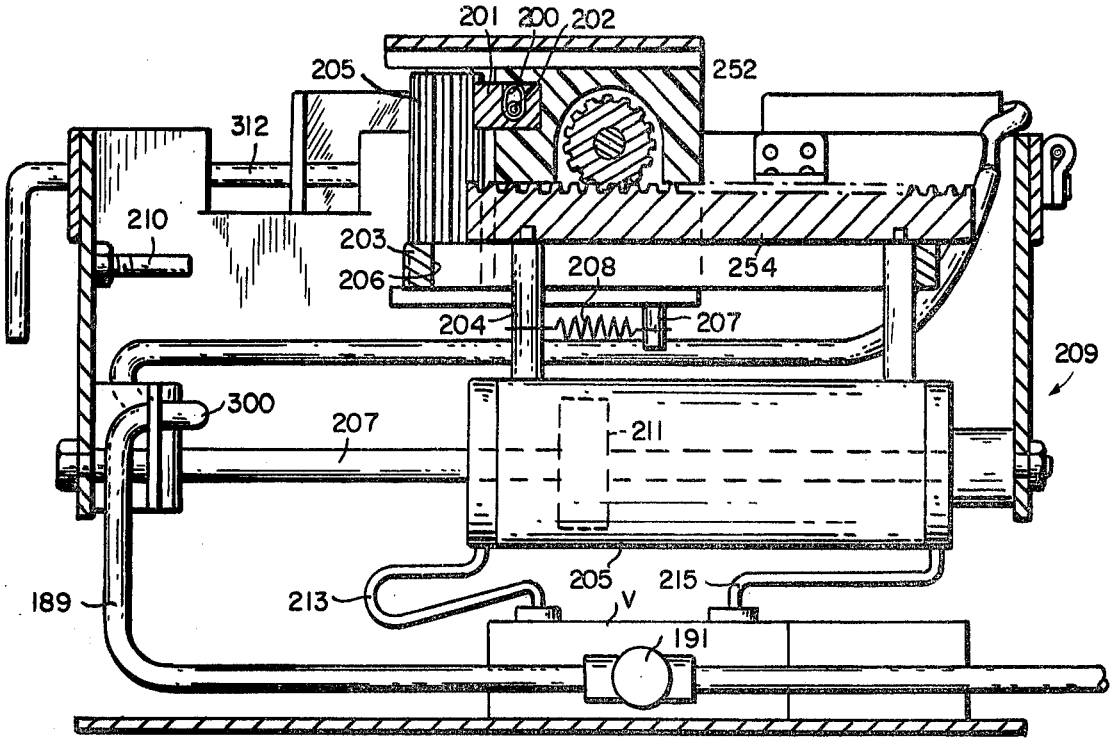
FIG. 22 is a view corresponding to FIG. 21 showing the drive means in loading position.

The measuring means for making sure that a predetermined length of thread is supplied and wound onto the bobbin for a predetermined sewing operation is like that described in conjunction with the form of the loading device shown in FIGS. 1 to 13 inclusive and comprises, as shown in conjunction with its alternate form of loading mechanism, FIGS. 20 and 23, a measuring disk 230 mounted for rotation on a horizontal shaft 232 projecting from a control box 234 mounted to the side of the mounting bracket 209, rotation of which effects rotation of the slotted disk internally of the box 234, not shown, which, by alternately permitting and blocking the passage of a light beam, generates a series of signals. The thread T is led from the package to the measuring disk 230 through an eye 236 at the underside of the mounting bracket, about a solenoid-actuated brake 238 and over a guide roll 240 to and about a measuring disk 230 and from a measuring disk 230 to the slack-producing means. A roller 242 rotatably mounted at the distal end of a spring-biased arm 244 supported on the box 234 yieldably holds the thread engaged with the measuring disk so that linear movement of the thread frictionally rotates the measuring disk. When the signals generated by rotation of the slotted disk within the box 234 indicate that a predetermined length of thread has been drawn from the thread package, the solenoid-operated air valve V in the control circuit reverses the flow of air to the cylinder 205 to cause the cylinder to retract the loading tube. Simultaneously, contacts are closed in the control circuit to energize the solenoid of the solenoid-operated brake 238 to cause the latter to frictionally grip the thread and stop further movement thereof. During the initial retractive movement of the loading tube, the clamp 216 is disengaged from the cam 224 so as to clamp the thread to the loading tube. Hence, the retractive movement of the loading tube actually withdraws a small amount of thread from the bobbin. Since the bobbin continues to be urged to rotate, the thread is held taut between the bobbin and the clamped portion of the thread within the loading tube at the retracted position of the loading tube.

The thread is now ready to be cut between the forward end of the loading tube and the bobbin and, desirably, as close to the forward end of the loading tube as possible. Prior to cutting, it is necessary to frictionally secure the thread at the bobbin case and this is provided for by thread manipulating means which, in this form of the device, is a hook which inserts the thread extending from the forward end of the loading tube through the opening in the bobbin case, beneath the pressure finger 62 on the bobbin case to frictionally constrain the thread. The hook 246 is rotatably mounted at one end of a horizontal shaft 248, FIG. 23, rotatably mounted in a bearing block 250 fastened to the mounting bracket 209 for rotation about an axis coinciding with the axis of rotation of the bobbin. The shaft 248 has on its opposite ends a gear 252 which meshes with a rack 254 fixed to the upper ends of the posts 204—204 so as to be reciprocal with the cylinder 205.0. A drive member 256 is keyed to the shaft 248 so as to be rotated and has on its periphery a notch 258, FIGS. 30–33. The hook 246 has pivotally mounted to it a latch 260 so oriented with respect to the drive member 256 that rotation of the latter will bring the notch into engagement with the latch and cause the hook to be rotated in a clockwise direction, as shown in FIGS. 30 to 33 inclusive, to a position to engage the thread T and pull it from the position shown in FIG. 26 to the position shown in FIG. 28, the effect of which is to cause it to be drawn beneath the pressure finger 62 on the bobbin case and to be gripped by the pressure finger, thus to prevent the thread from being withdrawn from the bobbin by the cutting action of the cutter. The hook 246 passes beyond the position necessary to engage the thread with the pressure finger and, as it does so, the latch 260 is disengaged from the notch 258 by a cam finger 262 pivotally mounted on the shaft 248. Disengagement of the latch 260 from the notch 258 releases the hook and the latter is restored in a counterclockwise direction to its original position by a coiled spring 264 coiled about the shaft 248 within the drive member 256. The point at which the hook will be released is adjustable by means of a link 266 connected at one end to the tail end 268 of the cam finger and at its other end to a post 270 by means of an adjustable set screw 272.

Immediately following release of the hook 246, the cutting means which comprises fixed and movable parts 274 and 276, FIGS. 26 and 28, is actuated to sever the thread adjacent the forward end of the loading tube. The fixed part 274 is a flat tool steel plate fastened to the mounting bracket 209 in a plane perpendicular to the axis of the shaft 248 and the movable part 276 is a flat tool steel plate rotatably mounted on the shaft 248 against the fixed part 274 for rotation in shearing relation thereto. Retraction of the movable part 274 is effected by means of a dog 278 extending radially from the drive member 256, FIGS. 26 and 28, which engages a pin 280 extending axially from the movable part 276. The pin 280 is situated at an angular distance from the notch 258 in the direction of rotation so that, immediately following release of the hook from the notch, the cutter will move into shearing relation to the thread. Counter-rotation of the shaft 248 takes place with the retractive movement of the rack bar 254.

It is desirable that the thread be cut as closely adjacent the forward end of the loading tube as possible, for example, to leave no more than approximately 1/32 of an inch of the cut end projecting from the tube to avoid the possibility of the cut end of the thread doubling over as it is projected into the bobbin case since doubling over may prevent it from entering the opening and thus prevent it from becoming entrained about the rapidly rotating bobbin. It is for this reason that the stop 210 is made adjustable.

Retraction of the rack bar 203 is effected by the spring 208 as the cylinder 205.0 moves back to its limiting position against the stop 210. Movement of the cylinder after the rack bar 203 has reached its limiting position relative to the rack bar 203 effects rotation of the shaft 248 and, hence, operation of the hook and cutter as related above.

As previously described, it is desirable that there be a slack length of thread at the entrance of the loading tube at the beginning of each loading operation. The slack-producing means employed in conjunction with this alternative form of the loading mechanism comprises, in one form, a fixed bar 282 and a movable bar 284, FIGS. 20, 26 and 28, over and under which the thread T is entrained as it leaves the measuring disk 230 and enters the rear end of the loading tube. The fixed bar 282 is a U-shaped loop, FIG. 2, of wire secured at its ends to the mounting bracket so that a portion 286 is horizontal and transverse to the movement of the loading tube. The movable bar 284 is a rectangular loop of wire fastened to the rear end of the rack bar 201 so that a portion 288 thereof is parallel to the portion 286. The part 288 is reciprocated relative to the part 286 and as the loading tube retracts, the brake 238 is at least partially released to allow thread to be pulled from the yarn package. Partial release of the brake 238, which was actuated to clamp the thread when the thread measuring device measured the length of thread to be wound on the bobbin, is effected by a switch S in the control circuit mounted on the mounting bracket 209 which has a switch-actuating arm 290 at one end of which there is a roller 292 supported by the arm in the path of movement of the rack bar 203 so as to be actuated by movement of the rack bar relative thereto. The switch arm is so located that it is actuated early in the retracted movement of the loading tube to introduce the resistance R into the coil of the solenoid-operated brake to thus reduce the holding power of the brake and so allow the thread to slip sufficiently to permit the slack-producing means to draw the thread from the package of thread. As illustrated, FIG. 2, the solenoid-operated brake 238 comprises spaced, parallel surfaces 294 and 296 between which the thread travels and a core piece 298 attached to the part 296 for drawing the latter into frictional engagement with the thread between it and the part 298 when the solenoid is energized.

The sequence of operation for the loading means for a single cycle takes place as follows with the aid of a control circuit such as that described earlier in this application and, for this reason, requires no further description. Initiation of a cycle of operation is effected by actuating a starting switch 122, the effect of which is to energize a solenoid-controlled valve V to supply air to one end of the cylinder 205.0 in a direction to cause the cylinder to move the loading tube toward loading position. Simultaneously, air is supplied through the conductor 204.0 to the air tube 202 in the feed tube and the solenoid-operated brake is released. As the cylinder 205.0 commences to move away from its retracted position, it releases a pinched portion 300 of air tube 189 which is supported by a bracket plate 304 at the rear end of the cylinder 205.0 to allow air to flow through the flexible tube 189 to the bobbin turbine and thus to bring the bobbin up to speed during the forward movement of the loading tube to the loading position. As the cylinder 205.0 continues to move the loading tube toward loading position, the clamp 216 is disengaged from the thread by the cam 224 and air is supplied by way of the valve V through the flexible conductor 204.0 to the loading tube so that, when the loading tube reaches the opening in the bobbin case, the thread has already been released and the air flowing through the loading tube projects the leading end of the thread through the opening in the bobbin case into the path of rotation of the bobbin. The rapidly rotating bobbin, as previously explained, has a plurality of peripherally-spaced flexible fingers 176 projecting inwardly from its opposite sides which ensnare and entrain the ends of the thread so as to wind the thread onto the bobbin. As the thread is wound onto the bobbin, the slack that was produced at the end of the preceding cycle is drawn through the loading tube. Linear movement of the thread as it is drawn through the loading tube effects rotation of the measuring disk 230 and, as the latter rotates, it produces signals which the control circuit interpets in such a way as to produce a very accurate measurement of the length of the thread and, when a predetermined length is so measured, applies the brake 238 which stops further withdrawal of the thread from the package of thread. The signal simultaneously initiates retraction of the loading tube by actuating the solenoid-operated valve V to supply pressure to the opposite end of the cylinder 205.0. Movement of the cylinder 205.0 in retraction disengages the clamp 216 from the cam 224 which held it away from the thread so as to allow it to re-engage the thread and clamp it to the loading tube. Thus, for a short period of time, the thread is drawn rearwardly and a small amount is drawn off the bobbin. The clamping action, however, stalls the thread between the delivery end of the loading tube and the bobbin within the bobbin case so that the thread is held under some tension. Immediately following the clamping of the thread, the solenoid-operated brake 238 is partially released by introduction of the resistance R into its coil so that the thread can be drawn from the package of thread under some constraint by movement of the bar 288 relative to the bar 286. The reason, as has been previously pointed out, for not allowing the brake to be completely released, is to prevent an excess of thread from being pulled from the package of thread. The thread drawn off in this fashion is given up as the loading tube moves forwardly on the succeeding cycle.

As the cylinder 205.0 moves toward its retracted position, the rack bar 203 moves into engagement with the stop 210 which limits its retraction. However, following engagement of the rack bar 203 with the stop 210, the cylinder 205.0 continues to be moved relative to the rack bar into engagement with the bracket plate 304 to pinch the tube portion 300 to thus cut off the air to the turbine. During the rearward movement of the cylinder 205.0, the rack bar 201, by way of the gear 205, rotates the shaft 248 and this rotates the hook 246 so as to draw the thread in the opening in the shuttle case under the pressure finger 62 so as to frictionally hold the thread at this point between the shuttle case and the delivery end of the loading tube, whereupon the hook is retracted and the movable part 286 of the cutter rotates and cuts the thread while held taut. The final movement of the cylinder 205.0 into engagement with the bracket plate 304 pinches the tube portion so as to stop delivery of air to the bobbin, thus ending the cycle so that the apparatus is in condition for the next cycle of operation.

While the slack-producing device just described is preferred, a pneumatically-operated slack-producing device may be used, as previously described in conjunction with the form of loading mechanism illustrated in FIG. 12.

The loading mechanism of FIGS. 15 to 33 inclusive is attached to the frame of the sewing machine by means of a bracket assembly 209 which is a substantially rectangular frame within which the aforesaid parts are mounted. At the rear side of the frame, there are transversely-spaced hinge fingers 306—306, FIG. 15, which are pivotally mounted on a spindle 308, the opposite ends of which are supported in transversely-spaced bearing plates 310—310 projecting rearwardly from a bracket plate 311 bolted to the frame of the sewing machine. The bracket plate 311 is provided with enlarged opening to enable adjusting the entire loading device vertically and horizontally to align the loading tube with the opening in the bobbin case. The bracket structure is thus pivotally movable away from the sewing machine frame about the axis of the spindle 308 to provide for access to the shuttle case and access to the mechanism itself for inspection and adjustment. The mounting bracket is held in a position to support the loading device in its operative position by a latch member 312 which is slidably mounted within rearwardly-extending, transversely-spaced flanges 314—314 projecting rearwardly from the bracket assembly and a flange 316 extending rearwardly from the bracket plate 311.

The system of the present invention, while utilizing the important and fundamental principles of the Rovin '840 patent, constitutes a significant improvement thereover in terms of providing a rugged, compact, highly versatile mechanical device, which is easily adaptable to the several common commercially available forms of lock stitch type sewing machines presently marketed. This includes machines with horizontally disposed bobbins and with vertically disposed bobbins, and both single and double needle machines.

In conjunction with the important mechanical improvements, the system incorporates a novel and advantageous solid-state control circuit which, while providing a high degree of accuracy and reliability, is capable of fabrication on a basis well within the economic requirements of the system as a whole.

It should be understood, of course, that the specific form of the invention herein illustrated and described is intended to be representative only, as certain changes may be made therein without departing from the clear teaching of the disclosure. Accordingly, reference should be made to the following appended claims in determining the full scope of the invention.

We claim:

1. Apparatus for withdrawing thread from a package of thread and presenting a predetermined length thereof to the bobbin of a sewing machine for winding thereon comprising a mounting bracket for securing the apparatus to the frame of the sewing machine, a feed tube for transporting the thread from the package to the bobbin, means mounting the feed tube on the mounting bracket for reciprocal movement into an out of loading position adjacent the bobbin, comprising a supporting sleeve mounted on said bracket, a loading arm mounted on said sleeve for pivoting movement, a drive gear mounted on said sleeve having a lost motion driving engagement with said loading arm, an actuator mounted on said mounting bracket and operably associated with said drive gear for rotating the arm to effect controlled pivotal movement of the loading arm into and out of loading position, and means operable to present a slack length of thread to said feed tube at the retracted position thereof.

2. Apparatus according to claim 1 comprising a thread manipulator element mounted for movement across the face of the bobbin for engagement with a thread extending in a predetermined path from the bobbin spool in a direction generally parallel to the bobbin spool axis, said loading arm, when in a retracted position, supporting said thread in said predetermined path and operating means connecting said thread manipulator element to said drive gear whereby said manipulator is momentarily operated upon retraction of said loading arm.

3. Apparatus according to claim 2 wherein the bobbin is supported in a bobbin case with its axis generally at right angles to the primary direction of motion of the thread manipulator such that the thread extends from an opening in the side of the bobbin case and wherein said bobbin case has a thread tensioning spring extending along a portion of the bobbin case wall and spanning a portion of said opening and thread-tensioning spring having a bite portion in its free end for reception of said thread upon displacement of the thread by said manipulator.

4. Apparatus according to claim 3 wherein the bite portion of said thread tension spring directly overlies a portion of said bobbin case wall and embodies a pair of spacing spring portions and one of said spring portions presses resiliently against the bobbin case wall to accommodate the displacement of the thread thereunder by said manipulator.

5. Apparatus according to claim 4 wherein the other of said spring portions is at least partially received in a recess in said bobbin case wall to preclude the passage of the thread thereunder.

6. Apparatus according to claim 2 wherein said operating means comprises a rock shaft rotatably supported within said sleeve, spring means which urges the rock shaft in a retracted direction and means for moving the rock shaft in an operating direction including a drive element actuated by said drive gear and means for effectively disengaging said drive element upon a predetermined rotation of said rock shaft.

7. Apparatus according to claim 6 wherein said drive element comprises a pawl carried by said drive gear and engageable with a drive shoulder on said rock shaft and cam-like means for disengaging said pawl from said drive shoulder after partial rotation of said rock shaft and during unidirectional rotation of said drive gear.

8. Apparatus according to claim 1 comprising severing means, a cutting arm mounting said severing means on said mounting bracket for pivoting movement across said predetermined path, and cam means on said cutting arm cooperating with the cam means on said sleeve for effecting timed motion of said cutting arm.

9. Apparatus according to claim 8 wherein the cam means on said cutting arm comprises a cam slot and the cam means supported on said sleeve comprises a member rotatably mounted on said sleeve and having lost motion driving engagement with said drive gear.

10. Apparatus according to claim 9 wherein said rotatably mounted member has lost motion driving engagement with said loading arm and wherein said loading arm is driven by said drive gear through said rotatably mounted member.

11. Apparatus according to claim 1 comprising thread clamping means carried by said loading arm and adapted for pivotal movement into and out of said clamping position, a first stop member engageable with said clamping means in the retracted position of the loading arm to move and retain said clamping means in a clamping position and a second stop member engageable with said clamping means in the loading position of said loading arm to open the clamping means.

12. Apparatus for withdrawing thread from a package of thread and presenting a predetermined length thereof to the bobbin of a sewing machine for winding thereon, comprising a mounting bracket for mounting the apparatus to the sewing machine, a feed tube for receiving and transporting the thread from the package to the bobbin, means mounting the feed tube on the bracket for reciprocal movement into and out of loading position relative to the bobbin, comprising a supporting rack mounted on the bracket for linear movement parallel to the axis of rotation of the bobbin, a drive gear meshing with said rack, an actuator mounted on the bracket operably associated with said drive gear for rotating the drive gear to effect rectilinear movement of said rack and the feed tube mounted thereto into and out of loading position and means operable to present a slack length of thread to the feed tube at the retracted position thereof.

13. Apparatus according to claim 12 wherein said actuator comprises a reciprocally mounted cylinder and the means operably connecting it to said gear comprises a second rack mounted on the bracket at right angles to the first rack and meshing with said gear and means for moving the second rack in reciprocation with the cylinder.

14. Apparatus according to claim 13 wherein there is means for effecting movement of the cylinder relative to the second rack.

15. Apparatus according to claim 13 wherein there is a rod fixed at its ends to the bracket mounting the cylinder for reciprocal movement and there is means for supplying pressure to the opposite ends of the cylinder.

16. Apparatus according to claim 13 wherein the second rack is mounted on the mounting bracket for linear movement relative to the longitudinal axis of the cylinder to and from the loading position, means for limiting retractive movement of the second rack while permitting the cylinder to move relative thereto a predetermined distance and mechanism operable by said movement of the cylinder relative to the second rack to cause the thread to be frictionally constrained at the bobbin and severed between said frictionally-constrained end and the retracted feed tube.

17. Apparatus according to claim 16 wherein said mechanism comprises a shaft rotatably mounted on the mounting bracket with its axis parallel to the first rack, and with one end adjacent the path of travel of the thread from the feed tube to the bobbin, a hook at said end arranged by rotation of the shaft to frictionally engage the thread at the end adjacent the bobbin spool and means at the other end of the shaft for effecting rotation of the shaft during movement of the cylinder relative to said second rack.

18. Apparatus according to claim 17 wherein said last means is a gear fixed to the other end of the shaft, a third rack with which the gear meshes and means for moving the gear in reciprocation with the cylinder.

19. Apparatus according to claim 17 wherein there is a cutter rotatable by said shaft to sever the thread between the frictionally engaged end of the thread and the retracted feed tube and means for connecting the cutter to the shaft for rotation therewith following operation of the hook.

20. Apparatus according to claim 12 wherein there is cutting means for severing the thread extending between the bobbin and the feed tube at the retracted position of the latter and means operable by movement of the cylinder relative to said rack to effect actuation of the cutting means following retraction of the feed tube.

21. Apparatus operable in cycles for withdrawing thread from a package of thread and presenting a predetermined length of said thread in each cycle to the rotating bobbin of a sewing machine for winding thereon comprising a mounting bracket for securing the apparatus to the frame of a sewing machine, feed means mounted to the bracket and reciprocally movable thereon for transporting thread from the package to a position to be received by the rotating bobbin of the sewing machine and slack-producing means operable once each cycle to present a slack length of thread to said reciprocal feed means at a retracted position of the reciprocal feed means, said slack-producing means being operable to produce a slack-length, substantially shorter than said predetermined length.

22. Apparatus according to claim 21 wherein operation of said slack-producing means is effected by retraction of the reciprocal feed means.

23. Apparatus according to claim 21 comprising means operable at the retracted position of the reciprocal feed means to effect operation of said slack-producing means.

24. Apparatus according to claim 21 wherein the slack-producing means comprise a part fixed with respect to the reciprocal feed means over which the thread is entrained on its way from the package to the reciprocal feed means.

25. Apparatus operable in cycles for withdrawing thread from a package of thread and presenting a predetermined length of said thread to the rotating bobbin of a sewing machine for winding thereon comprising a mounting bracket for securing the apparatus to the frame of the sewing machine, feed means mounted on the bracket and reciprocally movable thereon for transporting thread drawn from the package to a position to be received by said rotating bobbin and slack-producing means operable once each cycle to create a slack length of thread between the package and the reciprocal feed means, said slack-producing means being operable to produce a slack length, substantially shorter than said predetermined length.

26. Apparatus operable in cycles for withdrawing thread from a package of thread and presenting a predetermined length of said thread to the rotating bobbin spool of a sewing machine for winding thereon comprising a mounting bracket for securing the apparatus to the frame of the sewing machine, feed means mounted to the bracket and reciprocally movable thereon for transporting the thread from the package to a position to be received by said bobbin spool and slack-producing means operable once each cycle to create a slack length of thread between the package and the reciprocal feed means prior to delivering said thread to said bobbin spool, said slack-producing means being operable to produce a slack length, substantially shorter than said predetermined length.

27. Apparatus operable in cycles for withdrawing thread from a package of thread and presenting a predetermined relatively longer length of said thread to the rotating bobbin of a sewing machine for winding thereon comprising a mounting bracket for securing the apparatus to the frame of the sewing machine, reciprocal feed means for transporting thread drawn from the package to a position to be received by said rotating bobbin and slack-producing means operable once each cycle to create a relatively shorter length of slack thread between the package and the reciprocal feed means in advance of reception of said thread by said bobbin.

28. Apparatus operable in cycles for withdrawing thread from a package of thread and presenting a predetermined length of said thread to the rotating bobbin of a sewing machine for winding thereon comprising a mounting bracket for securing the apparatus to the frame of the sewing machine, feed means mounted to the bracket and reciprocally movable thereon for transferring said thread from the package to a position to be received by said rotating bobbin, means at a retracted position of the reciprocal feed means to clamp the thread thereto and slack-producing means operable to create a slack length of thread between the clamped thread and the package at the retracted position of the reciprocal feed means once each cycle, said slack-producing means being operable to produce a slack-length, substantially shorter than said predetermined length.

29. Apparatus according to claim 28 wherein there is means for frictionally retarding withdrawal of the thread from the package.

30. Apparatus according to claim 29 comprising means for reapplying said clamp means as the reciprocal feed means moves away from said retracted position.

31. Apparatus according to claim 28 comprising means for retracting the clamp means as the reciprocal feed means moves toward said retracted position.

32. Apparatus according to claim 28 wherein there is means for measuring the thread delivered to the instrumentality and means operable by delivery of a predetermined length of thread to initiate retraction of the reciprocal feed means.

33. Apparatus for withdrawing thread from a package of thread and presenting a predetermined length thereof to the rotating bobbin of a sewing machine for winding thereon comprising a mounting bracket for securing the apparatus to the frame of a sewing machine, feed means mounted to the bracket and reciprocally movable thereon for transporting thread to a position to be received by the rotating bobbin of the sewing machine and slack-producing means operable to present a slack length of thread to said reciprocal feed means at a retracted position of the reciprocal feed means, said slack-producing means comprising a part about which the thread is entrained on its course from the package to the reciprocal feed means, and means for moving said part transversely of said course at the retracted position of said reciprocal feed means.

34. Apparatus for withdrawing thread from a package of thread and presenting a predetermined length thereof to the rotating bobbin of a sewing machine for winding thereon comprising a mounting bracket for securing the apparatus to the frame of the sewing machine, feed means mounted to the bracket and reciprocally movable thereon for transferring said thread from the package to a position to be received by said rotating bobbin, means at a retracted position of the reciprocal feed means to clamp the thread thereto and slack-producing means operable to create a slack length of thread between the clamped thread and the package at the retracted position of the reciprocal feed means, means for measuring the thread delivered to the instrumentality, a brake operable in response to said measuring means upon delivery of a predetermined length of thread to apply the brake to the thread and simultaneously initiate retraction of the reciprocal feed means.

35. Apparatus according to claim 34 comprising means operable prior to operation of said slack-producing means to partially release said brake.

36. Apparatus for withdrawing thread from a package of thread and presenting a predetermined length thereof to the rotating bobbin of a sewing machine for winding thereon comprising a mounting bracket for securing the apparatus to the frame of the sewing machine, feed means mounted to the bracket and reciprocally movable thereon for transferring said thread from the package to a position to be received by said rotating bobbin, means at a retracted position of the reciprocal feed means to clamp the thread thereto and slack-producing means operable to create a slack length of thread between the clamped thread and the package at the retracted position of the reciprocal feed means, means for measuring the thread delivered to the instrumentality, means operable by delivery of a predetermined length of thread to initiate retraction of said reciprocal feed means, said means for measuring comprising a roller over which the thread is entrained rotatable by travel of the thread thereover to produce a signal when a predetermined length of thread has travelled over the roller, and means operable by the signal to apply the brake and initiate retraction of the feed means.

37. Apparatus for withdrawing thread from a package of thread and presenting a predetermined length thereof to the rotating bobbin of a sewing machine for winding thereon comprising a mounting bracket for securing the apparatus to the frame of a sewing machine, feed means mounted to the bracket and reciprocally movable thereon for transporting thread from a retracted position to a position to be received by the rotating bobbin of the sewing machine and slack-producing means operable to present a slack length of thread to said reciprocal feed means at its retracted position being mounted for reciprocal movement in a bracket means, said slack-producing means comprising fixed and movable parts about which the thread is entrained, said movable part being reciprocal with said reciprocal feed means.

* * * * *